US008340562B2

(12) United States Patent
Hatakeyama et al.

(10) Patent No.: US 8,340,562 B2
(45) Date of Patent: Dec. 25, 2012

(54) IMAGE FORMING APPARATUS, PROTECTIVE AGENT AND PROCESS CARTRIDGE

(75) Inventors: Kumiko Hatakeyama, Sagamihara (JP); Toshiyuki Kabata, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 721 days.

(21) Appl. No.: 12/535,181

(22) Filed: Aug. 4, 2009

(65) Prior Publication Data

US 2010/0034570 A1 Feb. 11, 2010

(30) Foreign Application Priority Data

Aug. 7, 2008 (JP) ..... 2008-204627

(51) Int. Cl.
*G03G 21/00* (2006.01)

(52) U.S. Cl. ..... 399/346; 399/350; 430/119.82; 430/119.83; 430/119.84

(58) Field of Classification Search ..... 399/346; 430/119.82
See application file for complete search history.

(56) References Cited

U.S. PATENT DOCUMENTS

| | | | | |
|---|---|---|---|---|
| 7,218,879 | B2 | 5/2007 | Enoki et al. | |
| 7,979,016 | B2 * | 7/2011 | Hatakeyama et al. | 399/346 |
| 8,173,343 | B2 * | 5/2012 | Nakamori | 430/66 |
| 8,180,271 | B2 * | 5/2012 | Hatakeyama et al. | 399/346 |
| 8,204,423 | B2 * | 6/2012 | Hatori et al. | 399/346 |
| 8,208,835 | B2 * | 6/2012 | Kabata et al. | 399/159 |
| 8,219,017 | B2 * | 7/2012 | Nakai et al. | 399/346 |
| 2006/0133872 | A1 * | 6/2006 | Sugiura et al. | 399/346 |
| 2006/0285897 | A1 * | 12/2006 | Sugiura et al. | 399/346 |
| 2007/0123435 | A1 * | 5/2007 | Usami | 508/100 |
| 2009/0010692 | A1 * | 1/2009 | Hozumi et al. | 399/346 |
| 2009/0232541 | A1 * | 9/2009 | Hatakeyama et al. | 399/111 |
| 2009/0285613 | A1 * | 11/2009 | Nakai et al. | 399/346 |
| 2011/0085824 | A1 * | 4/2011 | Hatakeyama et al. | 399/159 |
| 2011/0129269 | A1 * | 6/2011 | Seo et al. | 399/346 |
| 2011/0129270 | A1 * | 6/2011 | Seo et al. | 399/346 |
| 2012/0134725 | A1 * | 5/2012 | Kawahara et al. | 399/346 |
| 2012/0141177 | A1 * | 6/2012 | Urayama et al. | 399/346 |
| 2012/0195662 | A1 * | 8/2012 | Hasegawa et al. | 399/346 |

FOREIGN PATENT DOCUMENTS

| | | |
|---|---|---|
| JP | 2004-198662 | 7/2004 |
| JP | 2006-350240 | 12/2006 |
| JP | 2008-134467 | 6/2008 |

* cited by examiner

*Primary Examiner* — David Gray
*Assistant Examiner* — Geoffrey Evans
(74) *Attorney, Agent, or Firm* — Cooper & Dunham LLP

(57) ABSTRACT

An image forming apparatus including an image bearing member that bears a latent image and has a surface layer; a charging device that charges the surface of the image bearing member: a latent image forming device that forms the latent image on the surface of the image bearing member; a development device that develops the latent image formed on the surface of the image bearing member with a development agent to form a toner image thereon; a transfer device that transfers the toner image to a transfer medium; a cleaning device that removes residual toner remaining on the surface of the image bearing member after transferring the toner image to the transfer medium; and a protection agent supplying device that supplies a protection agent to the surface layer of the image bearing member that forms a protection layer thereon, wherein the protection agent comprises a metal soap and boron nitride and the amount of the boron nitride in the protection layer applied to the image bearing member after image formation is 0.3 μg/cm$^2$ or less.

15 Claims, 3 Drawing Sheets

IMAGE FORMING APPARATUS, PROTECTIVE AGENT AND PROCESS CARTRIDGE

FIELD OF THE INVENTION

The present invention relates to an image forming apparatus, a protective agent and a process cartridge.

DISCUSSION OF THE BACKGROUND

In the image forming apparatus using electrophotographic process, images are formed to recording media, etc. by processes of charging, irradiation, development, transfer etc. applied to an image bearing member. A minute amount of corona products produced in the charging process and/or residual toner remaining after the transfer process are attached to the surface of the image bearing member after the transfer process and these attached matters are removed by the cleaning process after the transfer process. Thereafter, another image is formed again on the image bearing member from the charging process.

A cleaning system having a rubber blade is typically used in the cleaning process because such a rubber blade has a simple and cost-saving mechanism with a good cleaning property. However, since the rubber blade is pressed against the image bearing member to remove the attached material on the surface thereof, the rubber blade and the image bearing member are under a large mechanical stress caused by friction between the surface of the image bearing member and the rubber blade. This easily leads to attrition of the rubber blade and the surface layer of the image bearing member, which shortens the working life of the rubber blade and the image bearing member. This attrition is significant particularly on the surface layer of an organic photoconductor. On the other hand, the toner for use in image formation is reduced in size to deal with the demand for improvement on the image quality. In the case of an image forming apparatus using a toner having a small particle diameter, the ratio of residual toner that slips through the edge portion of the cleaning blade and the surface of the image bearing member tends to increase. This is particularly true when the dimension accuracy and/or assembly accuracy is not sufficient or the cleaning blade partially vibrates, which prevents formation of quality images. Therefore, reducing the deterioration of the image bearing member and the cleaning blade caused by abrasion and improving the cleaning property of the surface of the image bearing member are demanded to elongate the working life of the image bearing member while maintaining the quality of images over a long period of time. To meet this demand, a protection agent (lubricant) is applied to the surface of an image bearing member to form a film layer of the protection agent thereon.

The protection agent applied to the surface of an image bearing member reduces the abrasion on the surface of the image bearing member caused by the friction between the cleaning blade and the image bearing member and/or the deterioration of the image bearing member caused by the discharging energy generated when the image bearing member is charged in the charging process. In addition, the protection agent applied to the surface of an image bearing member increases the lubricant property thereof, thereby reducing the partial vibration of the cleaning blade. Therefore, the amount of toner that slips through the cleaning blade in the cleaning process is reduced. However, the lubricant property and the protection property depend on the amount of the protection agent. An amount of the protection agent that is excessively small does not sufficiently demonstrate prevention effects on the attrition of the image bearing member, the deterioration of the image bearing member caused by AC charging, and the slip-through of toner. Therefore, there are disclosed image forming apparatuses in which the amount of a protection agent applied to the surface of the image bearing member is specified.

For example, an unexamined published Japanese patent application No. (hereinafter referred to as JOP) 2004-198662 describes an image forming apparatus in which an amount of zinc stearate (metal soap) applied to the surface of the image bearing member as a protection agent is specified by the ratio of zinc to all the elements detected by X-ray photoelectron spectroscopy (XPS) analysis on the surface of the image bearing members. In addition, X-ray fluorescence (XRF) analysis is used to specify the application amount of the protection agent to maintain the quality of images over an extended period of time. Image forming apparatuses diffused nowadays are normally capable of forming color images and the quality images are demanded. Thus, the dominant charging system currently employed uses a charging roller applying an AC voltage in which an AC voltage is overlapped with a DC voltage to the surface of the image bearing member. Furthermore, the AC charging system using a charging roller deals with the need for size reduction, produces less amount of oxidized gasses such as ozone and NOx and naturally is expected to be widely and continuously used in the future. However, an image bearing member is charged several hundreds to several thousands of times per second according to frequency when the AC charging system is used. Thus, the image bearing member is easily and heavily damaged in the AC charging system in comparison with a DC charging system in which an image bearing member is positively charged only once while the image bearing member passes through the charging device. Therefore, protecting the image bearing member from damage caused by charging is demanded in the AC charging system. In addition, since resource saving has been drawing a high attention recently, elongating the working life of each member and part is an issue. As described above, since the speed of deterioration of the image bearing member is fast in the AC charging system in comparison with the DC charging system, the typical method of protecting an image bearing member is insufficient and thus a new protection technology is demanded. Furthermore, when a metal soap is used, part of powder of the metal soap supplied to the image bearing member is known to slip through the cleaning blade, scatter and attach to the charging roller, which degrades charging. Mixing an inorganic lubricant such as mica and boron nitride with a metal soap instead of a simple use of the metal soap is known to be effective to avoid this problem. JOP 2008-134467 describes a technology in which mica or boron nitride is blended with a metal soap (zinc stearate) to reduce scattering of the metal soap to the charging roller and the abrasion of the cleaning blade for an extended period of time. In addition, JOP 2006-350240 describes a technology of supplying boron nitride to an image bearing member as a protection agent and demonstrates that since discharging hardly affect the characteristics of boron nitride in comparison with other lubricants such as metal soap, boron nitride prevents oxidization deterioration of the image bearing member by discharging and works as a good protection agent for the image bearing member.

The present inventors made a study about improvement on the protection function of the metal soap used as a protection agent for an image bearing member while varying the amount of the metal soap with reference to JOP 2004-198662. However, the present inventors have found that an increase in the amount of the metal soap leads to an excessive increase of the volume of the installed metal soap, which is against the needs of the size reduction. In addition, abrasion of the cleaning blade is inevitable in the long run even if a large amount of metal soap is installed. Therefore, while a great number of images are formed in total, the cleaning blade is abraded. Thus, the working life of the cleaning blade is not elongated although the working life of the image bearing member is elongated. To the contrary, when the amount of metal soap is too small, the abrasion of the image bearing member tends to be significant or components of toner easily attaches to the image bearing member, which may cause an adverse impact on the quality of images. Thus, reducing the amount of metal soap is not preferable, either. In addition, as described in JOPS 2008-134467 and 2006-350240, the protection agent mixed with mica and/or boron nitride covers the shortcomings described above. Judging from specific Examples, good results are obtained when the protection agent contains mica and/or boron nitride in a relatively large amount, i.e., from 40 to 80%. However, mica and boron nitride are inorganic material having a high hardness. Attachment of a large amount of such an inorganic material to the surface of the image bearing member tends to accelerate the attrition of the cleaning blade. On the other hand, restriction on the supply amount of the protection agent leads to a decrease of the supply amount of metal soap. Consequently, a suitable protection layer is not formed on the surface of the image bearing member and thus, the problems described are left unsolved.

SUMMARY OF THE INVENTION

Because of these reasons, the present inventors recognize that a need exists for an image forming apparatus that has an image beating member, a charging roller, and a cleaning blade having a long working life and maintains producing quality images for an extended period of time, and a protection agent and a process cartridge for use in the image forming apparatus.

Accordingly, an object of the present invention is to provide an image forming apparatus that has an image bearing member, a charging roller, and a cleaning blade having a long working life and maintains producing quality images for an extended period of time, and a protection agent and a process cartridge for use in the image forming apparatus.

Briefly this object and other objects of the present invention as hereinafter described will become more readily apparent and can be attained, either individually or in combination thereof, by an image forming apparatus including an image bearing member that bears a latent image and has a surface layer; a charging device that charges the surface of the image bearing member; a latent image forming device that forms the latent image on the surface of the image bearing member; a development device that develops the latent image formed on the surface of the image bearing member with a development agent to form a toner image thereon; a transfer device that transfers the toner image to a transfer medium; a cleaning device that removes residual toner remaining on the surface of the image bearing member after transferring the toner image to the transfer medium; and a protection agent supplying device that supplies a protection agent to the surface layer of the image bearing member that forms a protection layer thereon, wherein the protection agent comprises a metal soap and boron nitride and the amount of the boron nitride in the protection layer applied to the image bearing member after image formation is 0.3 $\mu g/cm^2$ or less.

It is preferred that, in the image forming apparatus mentioned above, the weight ratio of the metal soap to the boron nitride in the protection agent is from 70:30 to 95:5.

It is still further preferred that, in the image forming apparatus mentioned above, the protection agent includes a filler.

It is still further preferred that, in the image forming apparatus mentioned above, the filler is an aluminum particle.

It is still further preferred that, in the image forming apparatus mentioned above, the surface layer of the image bearing member includes a filler.

It is still further preferred that, in the image forming apparatus mentioned above, the amount of the metal soap in the protection layer after 500 images are formed is from 0.4 to 2.0 $\mu g/cm^2$.

It is still further preferred that, in the image forming apparatus mentioned above, the amount of the boron nitride in the protection layer after 1,000 images are formed is 0.3 $\mu g/cm^2$ or less.

It is still further preferred that, in the image forming apparatus mentioned above, the protection agent supplying device comprises an extension blade that uniformly forms the protection layer on the surface of the image bearing member.

It is still further preferred that, in the image forming apparatus mentioned above, the extension blade is in contact with the surface of the image bearing member in a counter manner.

It is still further preferred that, in the image forming apparatus mentioned above, the cross-section surface form of a portion of the extension blade which is in contact with the surface of the image bearing member has an obtuse angle.

It is still further preferred that, in the image forming apparatus mentioned above, the charging device employs a contact charging system or vicinity charging system in which an AC voltage overlapped with a DC voltage is applied to the surface of the image bearing member.

As another aspect of the present invention, a protection agent is provided which includes a metal soap; and boron nitride, wherein the weight ratio of the metal soap to the boron nitride in the protection agent is from 70:30 to 95:5, and the protection agent is supplied to an protection agent supplying device contained in an image forming apparatus including an image bearing member that bears a latent image, a charging device that charges the surface of the image bearing member, a latent image forming device that forms the latent image on the surface of the image bearing member, a development device that develops the latent image formed on the surface of the image bearing member with a development agent to form a toner image thereon, a transfer device that transfer the toner image to a transfer medium, a cleaning device configured to remove residual toner remaining on the surface of the image bearing member after transferring the toner image to the transfer medium, and the protection agent supplying device configured to supply a protection agent to the surface of the image bearing member that forms a protection layer thereon.

It is preferred that the protection agent mentioned above further includes a filler.

It is still further preferred that the protection agent is formed to have a bar form.

It is still further preferred that, in the protection agent, powder of the protection agent is compressed and molded to have the bar form.

As another aspect of the present invention, a process cartridge is provided that includes an image bearing member that bears a latent image; a charging device that charges the surface of the image bearing member; a development device that develops the latent image formed on the surface of the image bearing member with a development agent to form a toner image thereon; a cleaning device that removes residual toner remaining on the surface of the image bearing member after transferring the toner image to the recording medium; and a protection agent supplying device that supplies a protection agent to the surface of the image bearing member that forms a protection layer thereon, wherein the process cartridge is detachably attachable to the image forming apparatus mentioned above.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 2 is a diagram illustrating the contact state of the extension blade and the image bearing member.

DETAILED DESCRIPTION OF THE INVENTION

Figure 1:
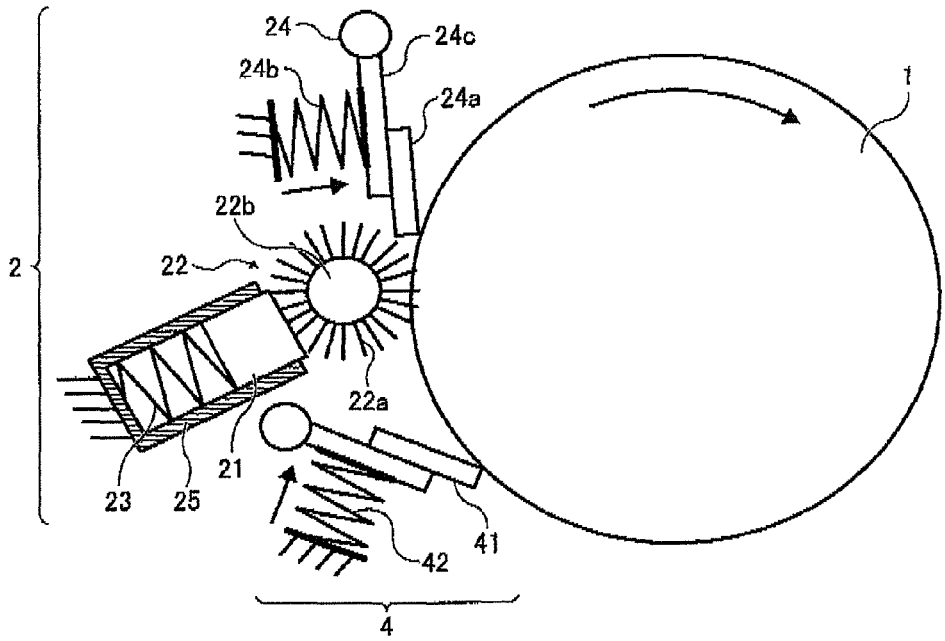
FIG. 1 is a schematic diagram illustrating an example of the arrangement of the protection agent application device including the protection agent of the present image to the image bearing member

The present invention will be described below in detail with reference to several embodiments and accompanying drawings.

A mixture of metal soap with boron nitride functioning as a protection agent to form a protection layer on the surface of the image bearing member in an image forming apparatus reduces scattering of powder of the metal soap to the charging roller or attrition of the cleaning blade in comparison with a simple use of the metal soap. In addition, boron nitride improves the protection function to the image bearing member because boron nitrides is hardly affected by discharging.

The present inventors evaluated the quality of images produced with usage of a mixture of metal soap and boron nitride functioning as a protection agent under various kinds of conditions and the deterioration status of each member or part of an image forming apparatus. Images produced under the conditions of the protection agent described in Examples of JOP 2008-134467 were evaluated.

The present inventors found that filming on the image bearing member occurred to the case evaluated as good in JOP 2008-134467 and blurred images were occasionally output. As summing up the evaluation results, the present inventors noticed that although no defects were observed in the image bearing member with naked eyes, blurred images were output in some cases but quality images were printed in other cases for several times of the same evaluations The cause of such a difference between the results was unknown. The present inventors formed images under the condition described in Examples of JOP 2006-350240 (the mixture ratio is from 10 to 80% by weight, which are not described in Examples). When the ratio surpassed 30%, image blurring started to occur when the number of formed images reached 1,000 and filming on the image bearing member was confirmed in some cases.

Thus, the present inventors have made inventive studies on the conditions in which the quality of images are maintained over an extended period of time using a protection agent in which boron nitride is mixed with metal soap.

As a result, the present inventors finally pinned down the cause of the filming on the image bearing member and the image blurring. That is, an attachment of boron nitride in an amount more than a threshold to the image bearing member leads to the filming and blurred images.

This is confirmed by observing the surface of the image bearing member that has filming or produces blurred images with a scanning electron microscope (SEM) to find a great number of boron nitride particles on the surface of the image bearing member. According to this, the present inventors assumed that there should be a suitable amount of boron nitride when boron nitride attaches to the surface of an image bearing member and made further studies. Then, the present inventors have found that when the amount of boron nitride surpasses 0.3 $\mu g/cm^2$, abnormal images are occasionally output but when the amount is 0.3 $\mu g/cm^2$ or less, the quality of output images is maintained.

The image forming apparatus of the present invention includes an image bearing member (photoreceptor) that bears a latent image; a charging device that charges the surface of the image bearing member; a latent image forming device that forms the latent image on the surface of the image bearing member; a development device that develops the latent image formed on the surface of the image bearing member with a development agent to form a toner image thereon; a transfer device that transfers the toner image to a transfer medium; a cleaning device configured to remove residual toner remaining on the surface of the image bearing member after transferring the toner image to the transfer medium; and a protection agent supplying device configured to supply a protection agent to the surface of the image bearing member that forms a protection layer thereon, wherein the protection agent contains a metal soap and boron nitride and the protection layer contains the boron nitride in an amount of 0.3 $\mu g/cm^2$ or less.

To be more specific, this image forming apparatus has an image bearing member having a protection layer mainly formed of metal soap which contains boron nitride in an amount of 0.3 $\mu g/cm^2$ or less, preferably 0.25 $\mu g/cm^2$ or less, and more preferably 0.2 $\mu g/cm^2$ or less.

On the other hand, the lower limit of the boron nitride can be 0 $\mu g/cm^2$ but is preferably 0.001 $\mu g/cm^2$, and more preferably 0.01 $\mu g/cm^2$. When the amount of boron nitride on the surface of the image bearing member after image formation surpasses 0.3 $\mu g/cm^2$, the image bearing member tends to be not uniformly charged so that abnormal images such as blurred images may be produced, which is not preferred.

Boron nitride is considered to improve the lubricant property between the image bearing member and the cleaning blade and thus reduce minute vibration of the cleaning blade. This makes the posture of the cleaning blade stable, which leads to reduction of the production of abnormal images having streaks ascribable to metal soap powder that has slipped through the cleaning blade and attached to the charging roller. In addition, attrition of the cleaning blade is restrained by the reduction of the minute vibration of the cleaning blade. Therefore, boron nitride is ideally present only on the contact portion of the image bearing member and the cleaning blade. The abrasive sliding between the image bearing member and the cleaning blade is smooth without a problem as long as boron nitride is attached to the cleaning blade although not present on the surface of the image bearing member.

The attachment amount of boron nitride to the surface of the image bearing member is 0.3 μg/cm$^2$ or less, preferably 0.25 μg/cm$^2$ or less, and more preferably from 0.001 to 0.2 μg/cm$^2$ any time after the image bearing member in the image forming apparatus of the present invention has produced a first image. The attachment amount of boron nitride to the surface of the image bearing member is 0.3 μg/cm$^2$ or less, preferably 0.25 μg/cm$^2$ or less, and more preferably from 0.001 to 0.2 μg/cm$^2$ particularly after the image forming apparatus has produced 100 images, 1,000 images, 10,000 images, or 100,000 images. When the amount of boron nitride on the surface of the image bearing member after image formation surpasses 0.3 μg/cm$^2$, the image bearing member tends to be not uniformly charged so that abnormal images such as blurred images are easily produced, which is not preferred.

In addition, when the amount of boron nitride on the surface of the image bearing member after image formation is less than 0.001 μg/cm$^2$, the amount of boron nitride attached to the cleaning blade tends to be small in most cases. Thus, boron nitride tends not to sufficiently demonstrate its function. Therefore, the attachment amount of boron nitride is preferably at least 0.001 μg/cm$^2$.

As to the actual marketed product, test printing is performed for the image forming apparatus or the process cartridge detachably attachable thereto to secure the product reliability. Thus several images are already printed by the image forming apparatus and the process cartridge before the product enters into the market.

In the image forming apparatus of the present invention newly manufactured or the process cartridge just replaced, boron nitride is not attached to the image bearing member therein in most cases.

However, since the protection agent is supplied to the image bearing member in the image forming apparatus or the process cartridge by the protection agent supply member during a test or trial printing, a protection layer is formed on the image bearing member and boron nitride is thus attached thereto. Therefore, no practical inconvenience occurs.

The protection agent supplied to form the protection layer by protection agent supply member contains metal soap and boron nitride preferably in a weight ratio of from 70:30 to 95:5.

When the ratio of metal soap is excessively small, the protection layer mainly formed of metal soap is not easily formed on the surface of the image bearing member, or a large amount of boron nitride may abrade the cleaning blade. When the ratio of metal soap is too large, the amount of boron nitride on the image bearing member or the cleaning blade is small, which makes it difficult to form a suitable protection layer.

The protection agent containing metal soap and boron nitride for use in the image forming apparatus of the present invention is preferable to contain particulates functioning as a filler.

The filler contained together with boron nitride means that the filler is contained in the protection layer and functions to scrape boron nitride attached to the image bearing member in an excessive amount.

There is no specific limit to the selection of the filler as long as the selected filler is not against the purpose of the present invention. Specific examples of the fillers include, but are not limited to, metal oxide particulates, metal multiple oxide particulates such as aluminum oxide (alumina), silicon oxide, titanium oxide, zirconium oxide, cerium oxide, strontium titanate, and methasilicate magnesium aluminate, and organic particulates such as silicone resin particulates and silicone rubber particulates.

Among these, alumina particulates are preferable in terms of stability, hardness, and availability of various kinds of particulate forms.

In the image forming apparatus of the present invention, the attachment amount of metal soap on the image bearing member after 500 images are formed is from 0.4 to 2.0 μg/cm$^2$ and preferably from 0.5 to 1.8 μg/cm$^2$.

An attachment amount of metal soap that is too small is not preferable because the metal soap tends not to demonstrate the function of reducing the abrasion of the image bearing member. An attachment amount that is too large is not preferable because the component of toner tends to attach to the image bearing member or the protection agent is thickly present thereon, which may lead to production of blurred images. The metal soap has a function of protecting the surface of the image bearing member with a good extension property and is required to be sufficiently supplied to the surface of the image bearing member from the initial usage thereof.

That is, when the protection agent mainly formed of metal soap is not sufficiently applied at the initial stage, the image bearing member starts to deteriorate from the initial stage. The metal soap supplied after the image bearing member has started deterioration is not easily attached to the surface of the image bearing member like before. Therefore, protection of the image bearing member at the initial stage is a large key. Any known stable metal soap is used. Fatty acid metal salts are known to be suitable. Specific example thereof include, but are not limited to, zinc stearate, barium stearate, lead stearate, iron stearate, nickel stearate, cobalt stearate, copper stearate, strontium stearate, calcium stearate, cadmium stearate, magnesium stearate, zinc palmitate, cobalt palmitate, lead palmitate, magnesium palmitate, aluminum palmitate, calcium palmitate, zinc oleate, magnesium oleate, iron oleate, cobalt oleate, copper oleate, lead oleate, manganese oleate, lead caprylate, lead caprate, zinc linolenate, cobalt linolenate, calcium linolenate, zinc ricinoleate, cadmium ricinoleate and a mixture thhreof. Among these, zinc stearate, zinc palmitate, and a mixture thereof are suitably used. An extension blade is preferably provided in addition to the cleaning blade as part of the protection agent supplying device to form a uniform protection layer on the surface of the image bearing member in the image forming apparatus of the present invention.

Just the cleaning blade possibly forms and extends the protection layer but toner and the protection agent may mix on the cleaning blade since the cleaning blade removes toner. Therefore, the simple use of the cleaning blade is not suitable to form a film of the protection agent on the image bearing member. Therefore, the image forming apparatus having two functionally separated blades of the cleaning blade and the extension blade is efficiently suitable to remove toner on the image bearing member and form a protection layer thereon.

The cleaning blade is preferably located on an immediate downstream side of the transfer process and the extension blade is preferably located on the downstream side of the cleaning process and the attachment process of the protection agent to the image bearing member.

In the present invention, the extension blade is preferably in contact with the image bearing member with an angle in a counter manner. When the extension blade is in contact with the image bearing member in a counter manner, an excessive attachment of boron nitride to the image bearing member is restrained.

In addition, providing the extension blade in a counter manner is preferable in terms of extending the protection agent to form a uniform protection layer on the surface of the image bearing member.

The cross-section surface form of the portion of the extension blade in the present invention which is in contact with the surface of the image bearing member preferably has an obtuse angle.

When the form of the contact portion of the extension blade has a right angle or acute angle, the contact portion is easily drawn into the rotation side of the image bearing member. When the contact portion has a form having an obtuse angle, the blade is extremely hardly drawn into the rotation side and thus stably in contact with the image bearing member, which prevents vibration of the blade. Thus, uniform extension of the protection agent and removal of the protection agent attached to the image bearing member in an excessive amount are considered to be easy.

The charging system that charges the image bearing member using a charging device employed in the image forming apparatus of the present intention is a contact or vicinity type and preferably uses an AC charging system in which an AC voltage is overlapped with a DC voltage. However, an image bearing member is charged several hundreds to several thousands of times per second depending on frequency when the AC charging system is used. Thus, the image bearing member is easily and heavily damaged in the AC charging system in comparison with a DC charging system in which an image bearing member is positively charged only once while the image bearing member passes through the charging device. Therefore, since the damage to the image bearing member in the AC charging system is extremely heavy in comparison with the DC charging system, protection of the image bearing member from damage caused by charging is highly demanded in the AC charging system.

Therefore, a uses of a protection agent containing boron nitride having a strong durability to discharging is extremely advantageous in comparison with a simple use of metal soap.

In addition, when the deterioration and/or abrasion of the image bearing member and metal soap are accelerated by the use of the AC charging system, the blade is also degraded in an accelerated manner. Therefore, the presence of boron nitride is extremely advantageous to restrain the abrasion and vibration of the blade, and stabilize the posture thereof. The image forming apparatus of the present invention preferably employs a process cartridge system in which a process cartridge is replaceable according to the working life of the image bearing member.

Therefore, the process cartridge of the present invention includes the image bearing member, the charging device, the development device, the cleaning device, the protection agent supply device, etc. described above for the image forming apparatus of the present invention.

Such a process cartridge can be exchanged as a spare part of the image forming apparatus of the present invention and the substitute can demonstrate all the functions described above and be a suitable part of the image forming apparatus. The protection agent is supplied to the protection agent supplying device included in the image forming apparatus of the present invention including an image bearing member that bears a latent image; a charging device that charges the surface of the image bearing member; a latent image forming device that forms the latent image on the surface of the image bearing member; a development device that develops the latent image formed on the surface of the image bearing member with a development agent to form a toner image thereon; a transfer device that transfers the toner image to a transfer medium; a cleaning device that removes residual toner remaining on the surface of the image bearing member after transferring the toner image to the transfer medium; and the protection agent supplying device that supplies the protection agent to the surface of the image bearing member that forms a protection layer thereon, wherein the protection agent contains a metal soap and boron nitride with a ratio of the metal soap and the boron nitride from 70:30 to 95:30.

The protection agent preferably contains a filler and the filler is preferably aluminum particles.

The detail of the protection agent is as described above.

The protection agent of the present invention is formed to have a bar form.

The protection agent can be easily supplied to the image bearing member by a simple mechanism when the protection agent molded to have a bar form is used. In addition, a suitable amount of the protection agent is uniformly supplied to the surface of the image bearing member.

The method of supplying the protection agent to the image bearing member from the protection agent bar is described later with reference to specific embodiments.

In the present invention, the protection agent bar is preferably molded by a compact molding method in which powder of the protection agent is compressed for molding. When a protection agent bar is formed by the compact molding, the obtained protection agent bar has a different hardness depending on the degree of compression. Since the true specific gravity of the protection agent and the amount placed in the molding form are preliminarily known, compacting the powder is adjusted such that thickness reflecting a desired degree of compacting is obtained so that the protection agent bar can be manufactured with good reproducibility. The compression degree of the protection agent bar is preferably such that the bulk specific gravity is from 88 to 98% and preferably from 90 to 95% based on the true specific gravity of the protection agent. When the bulk specific gravity of the protection agent bar is too small based on the true specific gravity of the protection agent, the mechanical strength of the protection agent bar tends to be weak. Therefore, cracking easily occurs to the protection agent bar when handling the protection agent bar, which is not preferred. When the bulk specific gravity of the protection agent bar is too large based on the true specific gravity, a pressing machine having a high power should be used and part of the protection agent bar is melted. This causes the protection agent to have a locally dependent hardness, which is not preferred, The protection agent bar formed by compact-molding such that the bulk specific gravity of the protection agent is from 88 to 98% based on the true specific gravity can be easily finely powdered even when a brush is pressed against the protection agent block under a pressure weaker than in the case of a protection agent bar manufactured by a melting molding method. Therefore, the brush does not deteriorate over a long period of time so that the protection agent can be stably supplied to the image bearing member, which is preferred.

In addition, when powder of boron nitride or alumina is mixed, a protection agent bar that maintains the mixed status can be manufactured by the compact molding method as long as mixing is sufficiently performed in the powder state.

Next, specific embodiments of the present invention are described with reference to accompanying drawings.

Embodiment 1

FIG. 1 is a diagram illustrating an example of arrangement of the protection agent supplying device to the image bearing member in the image forming apparatus of the present invention.

A protection agent application device 2 arranged facing a photoreceptor drum 1 having a drum form functioning as an image bearing member includes: a protection agent bar 21 formed by molding a protection agent mainly formed of zinc stearate to protect the photoreceptor drum 1 to have a form of bar (cylinder, quadratic prism, or a hexagonal column); a protection agent bar support guide 25 to support the protection agent bar 21 not to shake from back to front or from side to side; and a protection agent supplying member 22 having a brush 22*a* that rotates while in contact with the protection agent bar 21.

Furthermore, the protection agent application (supplying) device includes a pressure imparting mechanism (e.g., spring) 23 that transfers the protection agent to the brush 22*a* of the protection agent supplying member 22 by pressing the protection agent bar 21 against the brush 22*a* of the protection agent supplying member 22, and a protection layer formation mechanism 24 that thin-layers the protection agent supplied to the surface of the image bearing member by the protection agent supplying member 22.

The protection agent bar 21 for use in the present invention is formed by a melting molding method in which the protection agent is melted and the melted protection agent is molded followed by cooling down, or a compact molding method in which powder of the protection agent is compressed. In FIG. 1, a numeral reference 4 represents a cleaning device functioning as a cleaning device of the photoreceptor drum 1 which is placed on the upstream side of the protection agent application device 2 relative to the rotation direction of the photoreceptor drum 1. The cleaning device 4 cleans the surface of the photoreceptor drum 1 before the protection agent is applied thereto to cause the photoreceptor drum 1 to be properly charged. In addition, the cleaning device 4 has a function of helping a suitable application of the protection agent. Thus, the cleaning device 4 can be regarded as part of the protection agent application device 2.

The protection agent bar 21 related to the present invention is pressed against the brush 22*a* of the protection agent supplying member 22 by the pressure from the pressure imparting mechanism 23 formed of a pressing member such as a spring, etc. so that part of the protection agent 21 is attached to the brush 22*a*.

The attachment amount of the protection agent to the brush 22*a* can be changed by varying the pressure of the spring, etc.

The protection agent supplying member 22 rotates at a different linear speed from that of the photoreceptor drum 1 and thus the front end of the brush 22*a* abrasively slides with the surface of the photoreceptor drum 1 to supply the protection agent attached to the surface of the brush 22*a* to the surface of the photoreceptor drum 1.

The protection agent supplied to the surface of the photoreceptor drum 1 may not form a uniform protection layer at the time of supplying the protection agent. Therefore, the protection layer formation mechanism 24 having an extension blade 24*a* and a pressing member 24*b* such as a spring is provided to extend the protection agent supplied to the surface of the photoreceptor drum 1 to form a thin and uniform protection layer on the photoreceptor drum 1.

The extension blade 24*a* of the protection layer formation mechanism 24 employs a counter system in which the extension blade 24*a* is in contact with the surface of the photoreceptor drum 1 in a counter manner.

As described above, a suitable amount of the protection agent is applied to the photoreceptor drum 1 and is thin-layered by the protection layer formation mechanism 24 to form a protection layer on the photoreceptor drum 1.

Figure 3:
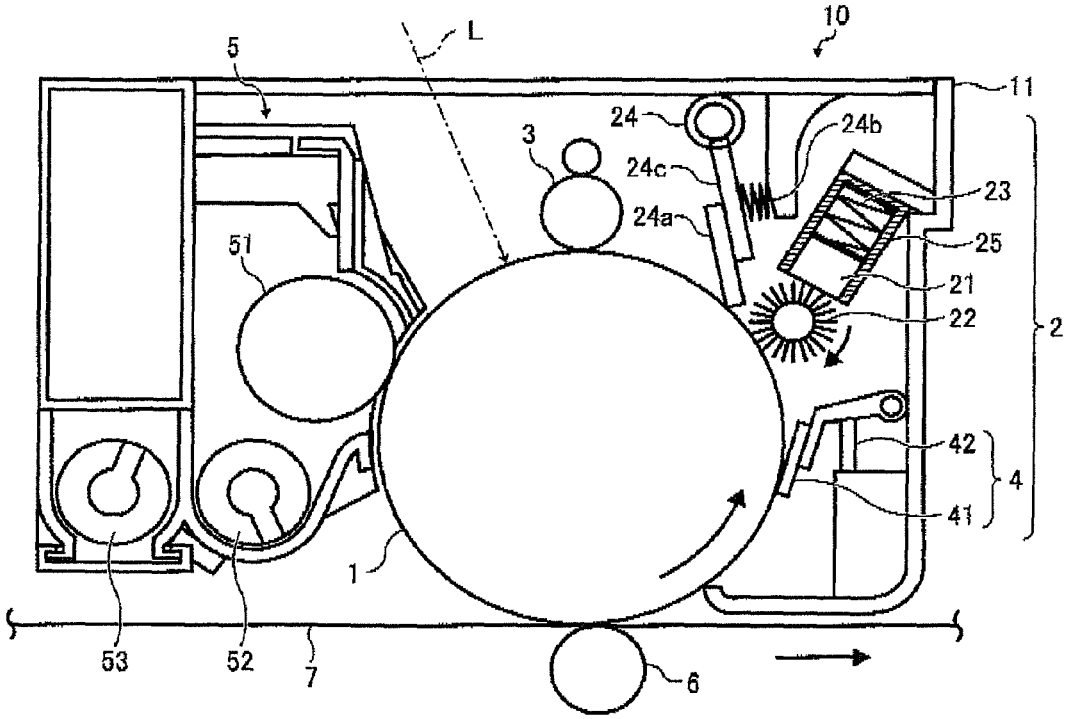
FIG. 3 is a schematic cross section of an example of the process cartridge having the protection agent of the present invention.

Thus, production of abnormal images ascribable to contamination on a charging device (e.g., charging roller) 3 illustrated in FIG. 3 is avoided and an-image forming apparatus that can output quality images for an extended period of time without frequent replacement of consumables is obtained.

In addition, powder of the protection agent can be supplied to the surface of the photoreceptor drum 1 instead of the protection agent bar.

In this case, a container to hold the powder of the protection agent, and a protection agent transfer device to transfer the powder of the protection agent are required but the protection agent bar, the pressure imparting mechanism 24 and the protection agent supplying member 22 are unnecessitated. A known powder transfer device such as a pump and an auger is used as the protection agent transfer device.

There is no specific limit to the selection of material for use in the extension blade 24*a* contained in the protection layer formation mechanism 24 and any material known for a cleaning blade can be used. Specific examples thereof include, but are not limited to, an elastic body such as urethane rubber, hydrin rubber, silicone rubber and fluorine rubber, Theses can be used alone or blended. In addition, the contact portion of these rubber blades with the photoreceptor drum 1 can be subject to coating or impregnation using material having a low friction coefficient. In addition, fillers such as organic fillers or inorganic fillers can be dispersed in the elastic body to adjust the hardness thereof. The extension blade 24*a* is fixed to a blade support 24*c* by an arbitrary method using, for example, adhesion or attachment such that the front end of the blade is directly in contact with and pressed against the surface of the photoreceptor drum 1. The thickness of the extension blade 24*a* is not necessarily unambiguously regulated considering the balance between the thickness of the extension blade 24*a* and the applied pressure but is preferably from about 0.5 to about 5 mm and more preferably from about 1 to about 3 mm. In addition, the length, i.e., free length, of the extension blade 24*a* having flexibility which protrudes from the support 24*c* is also not necessarily unambiguously regulated considering the balance between the free length and the applied pressure but is preferably from about 1 to about 15 mm and more preferably from about 2 to about 10 mm. As other structures of the extension blade 24 for use in protection layer formation, a layer of resin, rubber, elastomer, etc. is formed on the surface of an elastic metal blade such as a spring board by coating, dipping etc., via an optional coupling agent or primer component, and optionally, thermally cured. The formed layer can be subject to surface grinding treatment, if desired. The elastic metal blade has a thickness of preferably from about 0.05 to about 3 mm and more preferably from about 0.1 to about 1 mm. The elastic metal blade can be subject to treatment such as bending work to cause the blade significantly parallel to the spindle after attachment to prevent distortion of the blade.

Material such as fluorine resins such as PFA, PTFE, FEP, and PVdF, fluorine rubber, and silicone-based elastomers such as methylphenyl silicone elastomers can be used with an optional bulking agent to form the surface layer of the elastic metal blade.

Figure 2A:
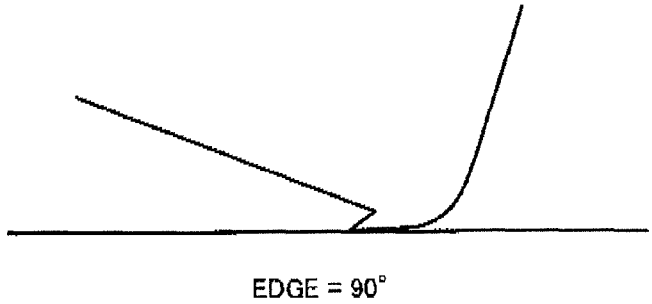
FIG. 2A is a state in which the blade edge has a right angle.
Figure 2B:
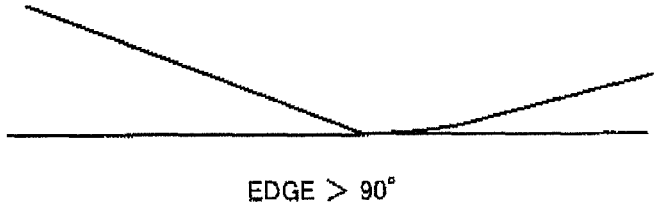
FIG. 2B is a state in which the blade edge has an obtuse angle.

FIG. 2 is a model chart to compare the forms of the front end of the blade in contact with the photoreceptor drum 1. FIG. 2A is a diagram illustrating a case in which the front end is in contact with the photoreceptor drum 1 with a right angle. FIG. 2B is a diagram illustrating a case in which the front end is in contact with the photoreceptor drum 1 with an obtuse angle. In the case of a right angle as illustrated in FIG. 2A, the front end of the blade is easily drawn to the moving direction of the surface of the photoreceptor drum 1, which may cause vibration of drawing and returning of the blade.

When the blade vibrates, non-uniform protection layer tends to be formed and part of boron nitride is easily separated.

To the contrary, when a blade with an obtuse angle is used as illustrated in FIG. 2B, the front end of the blade is hardly drawn to the moving direction of the photoreceptor drum 1 and metal soap and boron nitride form a uniform protection layer, thereby preventing boron nitride that tends to be separated from slipping through the extension blade 24*a* and excessively attaching to the surface of the photoreceptor drum 1. Thus, contamination of the charging roller is also reduced, which is extremely preferable. The pressure to press the blade 24*a* by the pressure member 24*b* of the protection layer formation mechanism 24 against the photoreceptor drum 1 is sufficient as long as the protection agent thereon is extended to form a uniform protection layer. The linear pressure is preferably from 5 to 80 gf/cm and more preferably from 10 to 60 gf/cm. The brush 22*a* is preferably used as the protection agent supply member 22 and preferably has flexibility to reduce the mechanical stress on the surface of the photoreceptor drum 1.

Known material or a combination thereof is selectively used to form flexible brush fiber. Specific examples thereof include, but are not limited to, polyolefin based resins (e.g., polyethylene and polypropylene); polyvinyl based resin or polyvinylidene based resins (e.g., polystyrene, acryl resin, polyacrylonitrile, polyvinylacetate, polyvinyl alcohol, polyvinyl butyral, polyvinyl chloride, polyvinyl carbazole, polyvinyl ether, and polyvinyl ketone); copolymers of polyvinyl chloride and vinyl acetate; copolymers of styrene and acrylic acid; styrene-butadiene resins; fluorine resins (e.g., polytetrafluoroethylene, polyvinyl fluoride, polyvinylidene fluoride, polychloro trifluoroethylene); polyester; nylon; acryl: rayon; polyurethane; polyearbonate: phenol resin, and amino resin (e.g., urea-formaldehyde resin, melamine resin, benzoguanamine resin, urea resin and polyamide resin). Dien based rubber, styrene-butadiene rubber (SBR), ethylene propylene rubber, isoplene rubber, nitrile rubber, urethane rubber, silicone rubber, hydrin rubber, norbornene rubber, etc, can be mixed with the brush fiber material specified above to adjust the degree of flexibility (bend). The brush 22*a*, which, for example, has a roll form, can be formed by winding a tape formed of pile fabric made from brush fiber around a core metal having a rotationable roll form (i.e., support 22*b*) in a spiral manner.

The brush fiber has a diameter of from 10 to 500 μm, and preferably from 20 to 300 μm.

A brush fiber having an excessively small diameter tends to extremely slow down the supply speed of the protection agent, which is not preferable. A brush fiber having an excessively large diameter tends to reduce the number of brush fibers per unit area. This causes uneven application of the protection agent on the photoreceptor drum 1 to be significant because the brush fiber does not contact depending on locations on the photoreceptor drum 1. In addition, the photoreceptor drum 1 is easily damaged by the contact with the brush 22*a*. Furthermore, since the force to scrape off the protection agent is strong, the working life of the protection agents tends to be short. Also, the protection agent supplied to the photoreceptor drum 1 tends to form a large particle. The large sized particles transferred to the charging roller easily contaminate the charging roller. Additionally, the large sized particles tend to increase the torque to rotate the brush 22*a* and the photoreceptor drum 1, which is not preferred.

The brush fiber has a length of from 1 to 15 μm, and preferably from 3 to 10 μm.

When the brush fiber having an excessively short length is used, the core metal of the brush is arranged in the immediate vicinity with the photoreceptor drum 1 and thus tends to damage the core metal by contact, which is not preferable. A brush fiber having an excessively long length tends to weaken the force to scrape off the protection agent by the top of the brush fiber and press against the photoreceptor drum 1. This is not preferred because supplying an ample amount of the protection agent to the photoreceptor drum 1 is difficult and the brush easily falls out.

The density of the brush of the brush 22*a* is from 10,000 to 300,000 pieces of fiber per square inch ($1.5\times10^7$ to $4.5\times10^8$ pieces of fiber per square meter).

A brush density that is too thin is not preferred because uneven application of the protection agent on the photoreceptor drum 1 is significant due to the fact that the brush fiber does or does not contact depending on locations on the photoreceptor drum 1, and supplying an ample amount of the protection agent to the photoreceptor drum 1 is difficult. In addition, an excessively high brush density requires an excessively small diameter of the brush fiber, which is not preferable. The protection agent supply member 22 preferably has a high brush density in terms of supply uniformity and supply stability. In addition, one piece of fiber is preferably manufactured from several to several hundreds of minute pieces of fiber. For example, as in 333 decitex (=6.7 decitex×50 filaments) (=300 denier=6 denier×50 filament), 50 pieces of fine fiber each having 6.7 decitex (6 denier) are bundled and implanted as one piece of fiber.

Among these protection agent supplying members 22, a brush formed of single fiber of from 28 to 43 μm and preferably from 30 to 40 μm is most preferred in terms of the efficiency of supply of the protection agent.

The fiber is mostly manufactured by twisting. Thus, the diameter of the fiber is not uniform and the units of denier and decitex have been used.

However, since single fiber has a uniform diameter, the protection agent supply member 22 is preferably specified by the fiber diameter.

A diameter of single fiber that is excessively small or large is not preferred because a diameter that is excessively small tends to reduce the efficiency of supplying the protection agent and a diameter that is excessively large tends to lead to excessive stiffness, thereby easily damaging the photoreceptor drum 1.

In addition, single fiber having a diameter of from 28 to 43 μm is preferably implanted to the core metal with an angle as close as possible to a right angle. The brush is preferably manufactured by electrostatic implanting using static electricity.

The electrostatic implanting is a method in which the core metal is charged to fly single fiber having a diameter of from 28 to 43 μm by the electrostatic force to implant it on an adhesive agent applied to the core metal followed by curing the adhesive agent.

A brush manufactured by electrostatic implanting which has a density of from 50,000 to 600,000 pieces of fiber per square inch is suitably used. In addition, a covering layer can be optionally formed on the surface of the brush 22*a* to stabilize the surface form of the brush 22*a* and environment stability. Any component that is flexible (bending property) according to the bending of the brush fiber is preferably used to form the covering layer. Specific examples thereof include, but are not limited to, polyolefin resins such as polyethylene, polypropylene, chlorinated polyethylene, and chlorosulfonated polyethyelene; polyvinyl or polyvinylidene resins such as polystyrene, acryl (e.g., polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; copolymers of vinyl chloride and vinyl acetate; silicone resins or modified products thereof having organosiloxane binding (e.g., modified products of alkyd resins, polyester resins, epoxy resins, or polyurethane resins), fluorine containing resins such as perfluoroalkyl ether, polyfluorovinyl, polyfluorovinylidene, and polychloro trifluoroethylene; polyamides; polyesters; polyurethanes; polycarbonates; amino resins such as urea and formaldehyde resins; epoxy resins; and complex resins thereof.

Embodiment 2

The process cartridge and the image forming apparatus of the present invention are described next.

FIG. 3 is a cross section illustrating a schematic structure example of the process cartridge hating the protection agent application device, which is provided to the image formation portion of the image forming apparatus of the present invention.

An image formation portion 10 illustrated in FIG. 3 includes; a photoreceptor drum 1 having a drum form functioning as an image bearing member; a charging device (charging roller in FIG. 3) that charges the photoreceptor drum 1; a latent image formation device (not shown except for a laser beam L) that irradiates the photoreceptor drum 1 with the laser beam L to form a latent electrostatic image thereon; a development device 5 that develops the latent electrostatic image on the photoreceptor drum 1 with toner to obtain a visualized (toner) image; a transfer device that transfers the toner image to a transfer medium (or intermediate transfer body); a cleaning device 4 that removes toner remaining on the surface of the photoreceptor drum 1 after transferring to clean the surface of the photoreceptor drum 1; and a protection agent application device 2 functioning as the protection agent supplying device arranged between the cleaning device 4 and the charging device 3.

This image formation portion 10 uses a process cartridge 11 including the photoreceptor drum 1, the protection agent application device 2, the charging device 3, the development device 5, and the cleaning device 4.

In the present invention, the cleaning device 4 is regarded as part of the protection agent application device 2 from a certain point of view because the cleaning device 4 has a function of cleaning the surface of the photoreceptor drum 1 before application of the protection agent to help smooth application of the protection agent.

In FIG. 3, the charging device 3, the latent image formation device (not shown), and the development device 5 form an image formation device. The charging device 3 is, for example, a charging roller employing an AC charging system in which an AC voltage is overlapped with a DC voltage by a high voltage power source (not shown).

In addition, the development device 5 is formed of a development roller 51 functioning as a development agent bearing member that bears and transfers a development agent including toner particles or a mixture of toner particles and carrier particles, and a development agent stirring and transfer members 52 and 53 that transfers the development agent while stirring.

The protection agent application device 2 arranged facing the photoreceptor drum 1 is mainly formed of the protection agent bar 21, the protection agent application member 22, the pressure imparting mechanism 23, the protection layer formation mechanism 24, and a protection agent bar support guide 25 that supports the protection agent bar 21 in order for the protection agent bar 21 not to shake from back to forth or from side to side as illustrated in FIG. 1.

In addition, the photoreceptor drum 1 has a surface on which partially degraded protection agent and toner components remain after the transfer process but the surface is cleaned by the cleaning device 4 having a cleaning blade 41.

In FIG. 3, the cleaning member 41 having a blade form is supported by a cleaning pressure imparting mechanism 42 and brought into contact with the photoreceptor drum 1 with an angle in a counter (leading) manner. The protection agent is supplied from the protection agent supply member 22 having a brush form to the surface of the photoreceptor drum 1 from which the residual toner and the degraded protection agent are removed by the cleaning device 4. The protection agent supplied to the surface of the photoreceptor drum 1 is thin-layered by the blade 24*a* of the protection layer formation mechanism 24 to form a protection layer. A latent electrostatic image is formed on the photoreceptor drum 1 having the thus prepared protection layer by irradiation of, for example, the laser beam L after charging the photoreceptor drum 1 by the charging roller 3, and developed by the development device 5 with toner to obtain a visualized image. Thereafter, the visualized image is transferred to the transfer medium 7 (or intermediate transfer medium) such as transfer paper by the transfer device (transfer roller 6) situated outside the process cartridge.

A small sized charging roller that produces less amount of oxidation gases such as ozone is used as the charging device 3 of the process cartridge 11 of the present invention. The charging roller 3 is arranged in contact with or in the vicinity (from 20 to 100 μm) of the photoreceptor drum 1 and charges the photoreceptor drum 1 by applying a voltage between the charging roller 3 and the photoreceptor drum 1. An AC voltage which is overlapped with a DC voltage is used as the voltage applied to between the charging roller 3 and the photoreceptor drum 1.

In the case of AC discharging, the photoreceptor drum 1 is easily degraded by discharging occurring more than several hundreds of times per second between the photoreceptor drum 1 and the charging roller 3.

In addition, the protection agent applied to the surface of the photoreceptor drum 1 is also degraded by discharging and may disappear. Thus, application of the protection agent to the surface of the photoreceptor drum 1 in a constant amount is a large factor. The charging roller preferably has a layer structure in which a polymer layer and a surface layer are provided on the electroconductive substrate. The electrconductive substrate functions as the electrode and supporting material of the charging roller 3 and is formed of electroconductive material, for example, metal or alloyed metal such as aluminum, alloy of copper, and stainless steel, electroplated iron with chrome, nickel, etc., and resins to which an elestroconductive agent is added. An electroconductive layer having a resistance of $10^6$ to $10^9$ Ω·cm is preferable as the polymer layer and material in which electroconductive agent is admixed with polymer material to adjust the resistance is suitably used. Specific example of the polymers for use in the polymer layer of the charging roller 3 for use in the image forming apparatus of the present invention include, but are not limited to, thermoplastic elastomers based on polyesters or olefins, polystyrene and styrene based thermoplastic resins such as copolymers of styrene and butadiene, copolymers of styrene and acrylonitrile, copolymers of styrene, butadiene and acrylonitrile, isoplene rubber, chloroplene rubber, epichlorohydrin rubber, butyl rubber, urethane rubber, silicone rubber, fluorine rubber, styrenebutadiene rubber, butadiene rubber, nitrile rubber, ethylene propylene rubber, copolymer rubber of epichlorohydrin-ethyleneoxide, copolymer rubber of epichlorohydrin-ethyleneoxide-arylglycidyl ether, three-dimension copolymer rubber of ethylene-propylne-dien (EPDM), copolymer rubber of acrylonitrile-butadiene, natural rubber and blended rubber material thereof. Among these rubber materials, silicone rubber, ethylene propylene rubber, copolymer rubber of epichlorohydrin-ethyleneoxide, copolymer rubber of epichlorohydrin-ethyleneoxide-arylglycidyl ether, copolymer rubber of acrylonitrile-butadiene, and rubber blend thereof are preferably used. These rubber materials that formed of foamed or non-foamed material are also suitably used. Electron conductive agents and ion conductive agents are used as the conductive agents. Specific examples of the electron conductive agents include, but are not limited to, fine powder of carbon blacks such as Ketjen black and acethylene black, pyrolytic carbon, graphite, electroconductive metals or alloyed metals such as aluminum, copper, nickel, stainless steel or alloyed metals, electroconductive metal oxides such as tin oxide, indium oxide, titanium oxide, solid dispersion of tin oxide and antimony oxide, solid dispersion of tin oxide and indium oxide, and insulative material the surface of which is electroconductive-treated. In addition, specific examples of the ion electroconductive agents include, but are not limited to, perchlorates or chlorates of tetraethyl ammonium, lauryl trimethyl ammonium, and perchlorates or chlorates of alkali metals or alkali earth metals such as lithium and magnesium. These electroconductive agents can be used alone or in combination. In addition, there is no specific limit to the addition amount thereof but the content of the electron conductive material is preferably from 1 to 30 parts by weight and more preferably from 15 to 25 parts by weight based on 100 parts of a polymer. The content of the ion conductive material is preferably from 0.1 to 5.0 parts by weight and more preferably from 0.5 to 3.0 parts by weight based on 100 parts of a polymer. As described above, there is no specific limit to the polymer material that forms the surface layer as long as the dynamic super microhardness of the surface of the charging roller 3 is from 0.04 to 0.5. Specific examples of the polymer material include, but are not limited to, polyamide, polyurethane, polyvinylidene fluoride, copolymers of tetrafluoroethylene, polyester, polyimide, silicone resins, acryl resins, polyvinyl butyral, copolymers of ethylene tetrafluoro ethylene, melamine resins, fluorine rubber, epoxy resins, polycarbonoate, polyvinyl alcohol, cellulose, polyvinylidene chloride, polyvinyl chloride, polyethylene, and copolymers of ethylene vinyl acetate. Among these, polyamide, polyvinylidene fluoride, copolymers of tetrafluoroethylene, polyester and polyimide are preferred in terms of the releasing property with toner, etc. These polymers can be used alone or in combination. In addition, the average molecular weight of the polymers is preferably from 1,000 to 100,000 and more preferably from 10,000 to 50,000.

The surface layer is formed of a composition (mixture) in which the elctroconductive agent for use in the electroconductive elastic layer and various kinds of particulates are mixed with the polymer material specified above. Specific examples of the various kinds of particulates include, but are not limited to, metal oxides and complex metal oxides such as silica, aluminum oxide, and barium titanate, polymer fine powder such as tetrafluoroethylene and vinylidene fluoride. These can be used alone or mixed for use.

The development device for use in the process cartridge of the present invention brings the development agent into contact with the photoreceptor drum 1 and develops a latent image formed on the photoreceptor drum 1 with the development agent to obtain a toner image.

A two-component development agent including toner and carrier or a single component development agent can be used as the development agent.

The development roller 51 functioning as the development agent bearing member in the development device 5 is partially exposed from the casing thereof as illustrated in FIG. 3. The toner replenished from a toner bottle (not shown) into the development device 5 is transferred and stirred with carrier by the development agent stirring and transfer members (screws) 52 and 53 to the development roller 51 where the toner is borne.

This development roller 51 is formed of a magnet roller functioning as a magnetic field generation device, and a development sleeve concentrically rotating around the magnet roller.

The carrier in the development agent forms a filament on the development roller 51 by the magnetic force generated by the magnet roller and the filament is transferred to the development area facing the photoreceptor drum 1.

The surface of the development roller 51 moves in the same direction as the surface of the photoreceptor drum 1 at a speed higher than that of the surface of the photoreceptor drum 1 in the development area.

The carrier forming the filament on the development roller 51 supplies toner attached to the surface of the carrier to the surface of the photoreceptor drum 1 while abrasively sliding with the surface of the photoreceptor drum 1.

A development bias is applied to the development roller 51 by a power source (not shown) to form a development electric field in the development area.

Consequently, a thus generated electrostatic force between the latent electrostatic image on the photoreceptor drum 1 and the development roller 51 is applied to the toner on the development roller 51 in the direction toward the side of the latent electrostatic image.

Therefore, the toner on the development roller 51 is attached to the latent electrostatic image on the photoreceptor drum 1.

The latent electrostatic image on the photoreceptor drum 1 is developed by this attachment to form a toner image thereon.

Embodiment 3

Another embodiment of the image forming apparatus of the present invention is described next.

Figure 4:
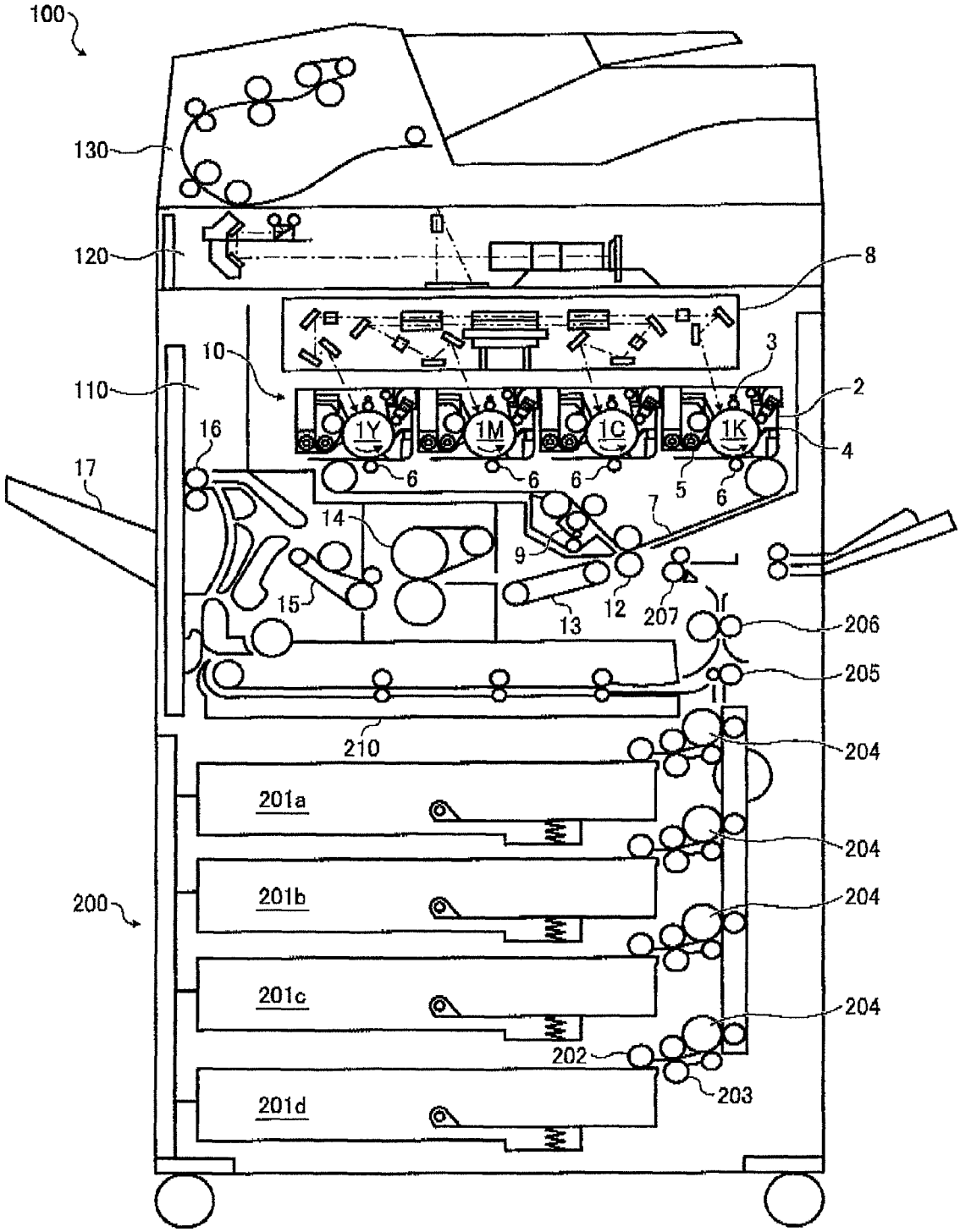
FIG. 4 is a schematic diagram illustrating an example of the image forming apparatus having the protection agent of the present invention.

FIG. 4 is a schematic diagram illustrating a structure example of the image forming apparatus 100 of the present invention having the protection agent application device. The image forming apparatus 100 includes a main body (printer portion) 110 of the image forming apparatus 100 that forms images, a document reader (scanner) 120 provided on the top of the main body 110, an automatic document feeder (ADF) 130 provided on the scanner 120, and a paper feeder 200 provided below the main body 110 and has a function of photocopying. In addition, the image forming apparatus 100 has a communication function with an outer device and thus can be used as a printer or a scanner when connected with a home computer-provided outside the image forming apparatus 100.

Furthermore, the image forming apparatus 100 connected with the telephone communication or optical line can be used as a facsimile machine. Four image formation portions (image formation stations) 10 of the development device 5, which have the same structure containing different color toner, are arranged in parallel in the main body 110. Images developed with toner having different colors of yellow (Y), magenta (M), cyan (C), and black (K) are formed at the four image formation portions 10 and each color toner image is transferred to and overlapped at a transfer medium or an intermediate transfer medium to form a multiple color or full color image.

The four image formation portions 10 in the example illustrated in FIG. 4 are arranged in parallel along the intermediate transfer medium 7 having a belt form suspended over multiple rollers. The color toner images produced at the respective image formation portions 10 are transferred to the intermediate transfer medium 7 where the color toner images are overlapped sequentially and thereafter transferred to a transfer medium having a sheet form such as paper at one time by a secondary transfer device 12.

Each image formation portion 10 for each color has the same structure as illustrated in FIG. 3 and includes the protection agent application device 2, the charging device 3, the irradiation portion such as a laser beam emitted from the latent image formation device 8, the development device 5, the primary transfer device 6 and the cleaning device 4, which are arranged around the photoreceptor drum 1 (1Y, 1M, 1C and 1K). The image formation portion 10 for each color uses a process cartridge 11 including the photoreceptor 1, the protection agent application device 2 (including the cleaning device 4), the charging device 3, and the development device 5.

This process cartridge 11 is detachably attached to the main body 110 of the image forming apparatus. The behavior of the image forming apparatus 100 is described with reference to FIG. 4. A series of the image formation processes are described using a negative-positive process.

The behavior of each image formation portion 10 is the same and thus the behavior of one of them is described. The photoreceptor drum 1, which is an image bearing member typically represented by an organic photoconductor (OPC) having an organic photoconductive layer, is discharged by a discharging lamp (not shown) and uniformly charged with a negative polarity by the charging device 3 having a charging member (e.g. charging roller). When the photoreceptor drum 1 is charged by the charging device 3, a voltage application mechanism (not shown) applies a charging bias having a suitable DC voltage or a voltage in which an AC voltage is overlapped with the suitable DC voltage to the charging member such that the photoreceptor drum 1 is charged to a desired voltage. A latent image is formed on the charged photoreceptor drum 1 by a laser beam emitted from the latent image formation device 8 employing a laser scanning system formed of, for example, multiple laser beam sources, a coupling optical system, an optical deflection device, a scanning image focusing optical system, etc. The absolute voltage at the irradiated portion is lower than the absolute voltage at the non-irradiated portion. The laser beam emitted from a laser beam source (e.g., semiconductor laser) is deflected by an optical deflection device including a polygon mirror having a polygonal column that rotates at a high speed and scans the surface of the photoreceptor drum 1 in the rotation axis direction (main scanning direction) of the photoreceptor drum 1 via a scanning image focusing optical system formed of a scanning lens, mirrors, etc. The thus formed latent image is developed by toner particles or a mixture of toner particles and carrier particles supplied onto the development sleeve of the development roller 51 functioning as a development agent bearing member included in the development device 5 to form a visualized toner image. When the latent image is developed, a voltage application mechanism (not shown) applies a development bias of a suitable DC voltage or AC voltage in which an AC voltage is overlapped with the suitable DC voltage to the development sleeve of the development roller 51.

The toner images formed on the photoreceptor drums 1 of the image formation portions 10 corresponding to respective colors are primarily transferred sequentially to and overlapped atop on the intermediate transfer medium 7 at the primary transfer device 6 including a transfer roller, etc.

At the same time, the transfer medium having a sheet form such as paper is fed from a paper feeder cassette selected among multiple-stacked paper feeding cassettes 201*a*, 201*b*, 201*c* and 201*d* of the paper feeder 200 by a paper feeding mechanism formed of a paper feeding roller 202 and a separation roller 203 in synchronization with the timing of image formation and primary transfer, and transferred to the secondary transfer portion via transfer rollers 204, 205 and 206 and a registration roller 207.

The toner image on the intermediate transfer medium 7 is secondarily transferred to the transfer medium at the secondary transfer portion by a secondary transfer device (for example, secondary transfer roller). A voltage having a polarity reversed to that of the toner charging is preferably applied to the primary transfer device 6 and the secondary transfer device 12 as a transfer bias in the transfer process described above. Thereafter, the transfer medium is separated from the intermediate transfer medium 7 at the secondary transfer and thus a transfer image is obtained on the transfer medium. In addition, the toner particles remaining on the photoreceptor drum 1 are retrieved into a toner collection room in the cleaning device 4 by the cleaning blade 41 of the cleaning device 4. In addition, the toner particles remaining on the intermediate transfer medium 7 after the secondary transfer are retrieved into the toner collection room in a belt cleaning device 9 by the cleaning blade of the belt cleaning device 9.

The image forming apparatus 100 illustrated in FIG. 4 is an image forming apparatus employing a tandem and intermediate transfer system in which the image formation portions 10 are arranged along the intermediate transfer medium 7. Multiple toner images having different colors sequentially formed on respective photoreceptor drums 1 (1Y, 1M, 1C and 1K) by the image formation portions 10 are sequentially transferred to the intermediate transfer medium 7 followed by transferring of the image to a transfer medium such as paper at one time. The transfer medium (recording medium) to which the toner image is transferred is transferred by a transfer device 13 to a fixing device 14 where the toner is fixed upon application of heat, etc.

The transfer medium after fixing is discharged to a discharging tray 17 by a transfer device 15 and a discharging roller 16.

In addition, this image forming apparatus 100 has a duplex mode. In the duplex mode, the image forming apparatus 100 switches the transfer path on the downstream side of the fixing device 9, reverses the transfer medium on which the image on one side is fixed back to front via a duplex transfer device 210 and re-feeds the transfer medium to the secondary transfer portion by the transfer roller 206 and the registration roller 207 to transfer an image to the back side of the transfer medium. The transfer medium after transferring of the image is transferred to the fixing device 9 where the image is fixed as described above and then discharged to the discharging tray 17 after fixing.

The image forming apparatus 100 may employ a tandem and direct transfer system in which no intermediate transfer medium is used while the other structures are the same as described above. In this direct transfer system, for example, a transfer belt that bears and transfers a transfer medium is used instead of the intermediate transfer medium. Multiple toner images of different colors sequentially formed on the respective photoreceptor drums 1 (1Y, 1M, 1C and 1R) are directly transferred to a transfer medium such as paper that is transferred by the transfer belt and then to the fixing device 9 where toner is fixed upon application of heat, etc.

Embodiment 4

The photoreceptor drum 1 suitably used in the image forming apparatus 100 and the process cartridge 11 of the present invention is described.

The photoreceptor drum 1 functioning as an image bearing member for use in the present invention includes an electroconductive substrate on which a photosensitive layer is provided. The photosensitive layer is typified into a single layer type in which charge generation material and charge transport material are present in a mixed manner, a sequential layer accumulation type in which a charge transport layer is formed on a charge generation layer and a reverse layer accumulation type in which a charge generation layer is formed on a charge transport layer. In addition, the photosensitive layer may be a surface layer which improves the properties such as the mechanical strength, anti-abrasion property, anti-gas property and cleaning property of the photoreceptor drum 1 (image bearing member). Furthermore, an undercoating layer is optionally provided between the photosensitive layer and the electroconductive substrate. In addition, an agent such as a plasticizer, an anti-oxidant and a leveling agent can be added in a suitable amount to each layer. The electroconductive substrate is made of material having a volume resistance of not greater than $10^{10}$ Ω·cm. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and grinding is also usable. The substrate having a drum form preferably has a diameter of from 20 to 150 mm, more preferably from 24 to 100 mm and particularly preferably from 28 to 70 mm. When the diameter of the drum is too small, arrangement of devices performing processes of charging, irradiation, development, transfer, cleaning, etc. around the image bearing member tends to be physically difficult. A diameter that is too large is not preferred because it tends to result in an increase in the size of the image forming apparatus. In particular, when the image forming apparatus 100 employs a tandem type as illustrated in FIG. 4, multiple photoreceptor drums 1 are installed so that the diameter is preferably 70 mm at most and more preferably 60 mm at most.

In addition, the endless nickel belt, and the endless stainless belt described in JOP 2006-350240 can be used as the electroconductive substrate.

Material for use in the undercoating layer of the photoreceptor drum 1 for use in the image forming apparatus 100 is, for example, a resin, a mixture mainly formed of a white pigment or a resin, an oxidized metal film formed by chemically or electrochemically oxidizing the surface of the electroconductive substrate. Among these, a mixture mainly formed of a white pigment or a resin is preferable. Specific examples of the white pigments include, but are not limited to, metal oxides such as titanium oxide, aluminum oxide, zirconium oxide, and zinc oxide. Among these, a white pigment containing titanium oxide is particularly preferable in terms of charge infusion prevention from the electroconductive substrate. Specific examples of the resins for use in the undercoating layer include, but are not limited to, thermoplastic resins such as polyamide, polyvinylalcohol, casein, methylcellulose and thermocuring reins such as acryl, phenol, melamine, alkyd, unsaturated polyesters, and epoxy, and a mixture thereof. Specific examples of the charge generation material of the photoreceptor for use in the image forming apparatus of the present invention include, but are not limited to, azo pigments such as monoazo-based pigments, bisazo-based pigments, trisazo-based pigments, and tetrakisazo-based pigments; organic-based pigments and dyes such as triaryl methane-based dye, thiazine-based dye, oxazine-based dye, xanthene-based dye, cyanine-based dye, styryl-based dye, pyrylium-based dye, quinacridone-based pigment, indigo-based pigment, perylene-based pigment, polycyclic quinone-based pigment, bisbenzimidazole-based pigment, indanthrone-based pigment, squarylium-baed pigment, and phthalocyanine-based pigment; and inorganic material such as selenium, selenium-arsenic, selenium-tellurium, cadmium-sulfide; zinc oxide; titanium oxide, and amorphous silicone. These can be used alone or in combination.

The undercoating layer can have a laminate structure. Specific examples of the charge transport material of the photoreceptor for use in the image forming apparatus of the present invention include, but are not limited to, anthracene derivatives, pyrene derivatives, carbazole derivatives, tetrazole derivatives, metallocene derivatives, phenothiazine derivatives, pyrazolline derivatives, hydrazone derivatives, styryl derivatives, styryl hydrazone derivatives, enamine compounds, butadiene compounds, distyryl compounds, oxazole compounds, oxadiazole compounds, thiazole compounds, imidazole compounds, triphenyl amine derivatives, phenylene diamine derivatives, aminostilbene derivatives, and triphenyl amine derivatives. These can be used alone or in combination. The resins for use in forming the photosensitive layer of the charge generation layer and the charge transport layer are insulative and known thermoplastic resins, thermocuring resins, photocuring resins and photoconductive resins. Specific examples of such resins include, but are not limited to, thermoplastic resins such as polyvinyl chloride, polyvinylidene chloride, copolymers of vinyl chloride and vinyl acetate, copolymers of vinyl chloride-vinyl acetate-maleic anhydride, copolymers of ethylene-vinyl acetate, polyvinyl butyral, polyvinyl acetal, polyester, phenoxy resins, (meth) acrylic resin, polystyrene, polycarbonate, polyarylate, polysufone, polyether sulfone, and ABS resins; thermocuring resins such as phenol resins, epoxy resins, urethane resins, melamine resins, isocyanate resins, alkyd resins, silicone resins, and thermocyring acryl resins, polyvinyl carbazole, polyvinyl anthracene and polyvinyl pyrene. These can be used alone or in combination.

When the charge transport layer forts the surface layer, a resin containing polycarbonate is used.

Specific examples of anti-oxidization agents are as follows:

2,6-di-t-butyl-p-cresol, butylized hydroxyl anisole,
2,6-di-t-butyl-4-ethylphenol,
stearyl-β-(3,5-di-t-butyl-4-hydroxyphehyl)propionate, and
3-t-butyl-4-hydroxynisole.

Bisphenol Based Compound 2,2'-methylene-bis-(4-methyl-6-t-butylphenol),
2,2'-methylene-bis-(4-ethyl-6-t-butylphenol),
4,4'-thiobis-(3-methyl-6-t-butylphenol),
4,4'-butylidenebis-(3-methyl-6-t-butylphenol).

Phenol Based Polymer 1,1,3-tris-(2-methyl-4-hydroxy-5-t-butylphenol)butane,
1,3,5-trimethyl-2,4,6-tris(3,5-di-t-butyl-4-hydroxybenzyl) benzene,
tetrakis-[methylene-3-(3',5'-di-t-butyl-4'-hydroxyphenyl) propionate]methane,
bis[3,3'-bis(4'hydroxy-3'-t-butylphenyl)butylic acid]glycol ester, and tocophenols.

Paraphenylene Diamine

N-phneyl-N'isopropyl-p-phenylene diamine,
N,N'-di-sec-butyl-p-phenylene diamine,
N-phneyl-N-sec-butyl-p-phenylene diamine,
N,N'-di-isopropyl-p-phneylene diamine, and N,N'-dimetyl-N,N'-di-t-butyl-p-phenylene diamine.

Hydroquinone 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

Organic Sulfide dilauryl-3,3-thiodipropionate, distearyl-3,3'-thiodipropionate, and ditetradecyle-3,3f-thiodipropionate.

Organic Phosphorous Compound triphenyl phosphine, tri(nonylphenyl)phosphine, tri(dinonylphenyl)phosphine, tricresyl phosphine, and tri(2,4-dibutylphenoxy)phosphine.

Known plasticizers, for example, dibutyl phthalate and dioctyl phthalate, can be used as the plasticizers. Its content is suitably from 0 to about 30 parts by weight based on 100 parts by weight of the binder resin.

A leveling agent is optionally added to the charge transport layer.

Specific examples of the leveling agents include, but are not limited to, silicon oils such as dimethyl silicone oil and methylphenyl siliconeoil and polymers or oligomers having a perfluoroalkyl group in its side chain and its suitable content is from 0 to 1 parts by weight based on 100 parts by weight of the binder resin. The surface layer is provided to improve the mechanical strength, anti-abrasion property, anti-gas property, cleaning property of the image bearing member as described above. Polymers having a mechanical strength stronger than the photosensitive layer, and polymers in which inorganic fillers are dispersed are preferably used to form the surface layer. A thin uppermost surface layer causes no problem even without a charge transport power. However, when the thickness of the uppermost surface layer increases without having a charge transport power, problems tend to arise such that the sensitivity of the image bearing member deteriorates, the voltage increases after irradiation, and the residual voltage increases. Therefore, adding the charge transport material specified above to the surface layer or using a polymer having a charge transport power in the surface layer is preferred. Since the mechanical strength is significantly different between the photosensitive layer and the surface layer in general, when the surface layer is abraded and disappears, the photosensitive layer also disappears soon. Therefore, the surface layer is desired to have a sufficient thickness which is a thickness of from 0.1 to 12 μm, preferably from 1 to 10 μm and more preferably from 2 to 8 μm.

When the layer thickness of the surface layer is too thin, part of the surface layer is easily abraded with the cleaning blade and disappears and thus the photosensitive layer is abraded in an accelerated manner from the disappeared portion. When the layer thickness of the surface layer is too thick, the photosensitivity tends to deteriorate and the voltage after irradiation and the residual voltage tend to rise. This should be avoided particularly when a polymer having a charge transport power is used in terms of cost. Since material transparent to writing light, and having excellent insularity, mechanical strength and adhesiveness is preferable as the polymer for use in the surface layer, polycarbonate is used in the uppermost layer of the photoreceptor.

Particulates of metal or metal oxide is optionally dispersed in the surface layer to improve the mechanical strength of thereof. Specific examples of the metal oxides include, but are not limited to, aluminum oxide (alumina), titanium oxide, tin oxide, potassium titanate, TiO, TiN, zinc oxide, indium oxide, and anthimony oxide. Fluorine resins such as polytetrafluoroethylene, silicone resins, or a mixture in which inorganic material is dispersed in these resins can be added to improve the anti-abrasion property. The image bearing member is described as the photoreceptor in Embodiments described above. In addition, the image bearing member relating to the present invention can be an intermediate transfer medium for use in image formation according to the intermediate transfer system in which a toner image formed on the photoreceptor is primarily transferred to overlap color images and the overlapped color image is transferred to a transfer medium. The intermediate transfer medium is preferably electroconductive with a voltage resistance of from $1.0\times10^{5}$ to $1.0\times10^{11}$ Ω·cm. A volume resistance that is too low may cause discharging, which leads to disturbance of formation of a toner image when the toner image is transferred from the image bearing member to the intermediate transfer body. When the volume resistance is too large, the charges to the toner image tend to remain on the intermediate transfer body which may appear on the next images as an accidental image after the toner image is transferred from the intermediate transfer body to a recording medium such as paper. The intermediate transfer medium is preferably electroconductive with a surface resistance of from $1.0\times10^{8}$ to $1.0\times10^{13}$ Ω/sq.

A surface resistance that is too low tends to cause problems such that toner images are disturbed, and transfer dust may be produced. A surface resistance that is too high tends to cause a problem such that performance of the primary transfer deteriorates. Plastic etc., having a belt form or a cylinder form that is manufactured by, for example, mixing and kneading metal oxide such as tin oxide or indium oxide, or electroconductive particles or electroconductive polymers alone or in combination with a thermoplastic resins followed by extraction can be used as the intermediate transfer medium. An intermediate transfer medium having an endless form can be manufactured by optionally adding the electroconductive particles or electroconductive polymers to a liquid resin containing cross-linking reactive monomers or oligomers and centrifugal molding while heating. A component excluding the charge transport material from the material for the surface layer for use in the surface layer of the photoreceptor is used and the resistance thereof is adjusted using an electroconductive material in combination on a suitable basis when the surface layer is provided to the intermediate transfer medium.

Embodiment 5

The toner suitably used for the image forming apparatus 100 and the process cartridge 11 of the present invention is described next.

The toner for use in the image forming apparatus of the present invention preferably has an average circularity of from 0.93 to 0.00. In the present invention, the circularity is defined as the value obtained from the following relationship (1): The (average) circularity is an indicator of the concavo-convex degree of toner particles and a toner particle having perfect sphere has a circularity of 1.00. As the complexity of the surface form of a toner particle increases, the toner particle has a small circularity value.

Circularity SR=(length of the circumference of a circle having the same area as that of the projected image of a particle)/(length of the circumference of the projected image of the particle) . . . Relationship (1). When the average circularity is from 0.93 to 1.00, the surface of the toner particle is smooth and the contact area between toner particles, and toner particles and the image bearing member is small so that the transferability of the toner is good. In addition, since such toner particles do not have an angled (pointed) portion, the stirring torque of the development agent in the development device is small and driving for the stirring is stabler which leads to no production of abnormal images. In addition, since no angular toner particles are contained in particles that form dots, when the toner particles are pressed against a recording (transfer) medium during the transfer process, the pressure is uniformly applied to the toner particles, which prevents formation of hollow portions. In addition, since the toner particle is not angular, the toner particle itself hardly grinds, or damages or abrades the surface of the image bearing member.

The measuring method of the circularity is described. The circularity can be measured by a flow type particle image analyzer FPIA-1000 manufactured by SYSMEX CORPORATION. The specific measuring procedure is as follows: a surfactant serving as a dispersant, preferably 0.1 to 5 ml of an alkylbenzenesulfonic acid salt, is added to 100 to 150 ml of water from which solid impurities have been removed; 0.1 to 0.5 g of a sample to be measured is added to the solution; the liquid suspension in which the sample is dispersed is subjected to an ultrasonic dispersion treatment for about 1 to 3 minutes such that the concentration of the particles is 3,000 to 10,000 particles per microlitter; and the form and particle size of the toner are measured using the instrument mentioned above. The toner for use in the image forming apparatus of the present invention preferably has a weight average particle diameter D4 of from 3 to 10 μm in addition to the circularity described above. In this range, the dot representability is excellent because toner particles have a particle diameter sufficiently small in comparison with a minute latent dot.

A weight average particle diameter D4 that is too small easily causes problems of deterioration of transfer efficiency and blade cleaning property.

Reduction of scattering of characters or lines is difficult when a weight average particle diameter D4 that is too large is used.

The toner related to the present invention has a ratio (D4/D1) of the weight average particle diameter D4 to the number average particle diameter D1 is preferably from 1.00 to 1.40.

As the ratio of D4/D1 approaches to 1, the toner has a sharper particle size distribution. Therefore, when the ratio (D4/D1) is in the range of from 1.00 to 1.40, the quality of images is stable because the selection development phenomenon ascribable to the toner particle diameter is avoided. In addition, since the particle size distribution of the toner is sharp, the distribution of the amount of friction charge is also sharp, which leads to prevention of occurrence of fogging. Furthermore, when the toner particle diameter size is within a small range, latent image dots are developed in an orderly and densely arranged manner, which leads to excellent dot reproducibility.

The measuring method of the particle size distribution of toner particles is described. Coulter Counter TA-II and Coulter Multisizer II (both are manufactured by Beckman Coulter, Inc.), etc. can be used as the measuring equipment in Coulter counter method.

The measuring method is as follows: First, add 0.1 to 5 ml of a surface active agent (preferably alkylbenzene sulfonic salt) as a dispersant to 100 to 150 ml of an electrolytic aqueous solution; The electrolytic aqueous solution is approximately 1% NaCl aqueous solution prepared by using primary NaCl. For example, ISOTON-II (manufactured by Beckman Coulter, Inc.) can be used; Add 2 to 20 mg of a measuring sample: Conduct dispersion treatment for the electrolytic aqueous solution in which the measuring sample is dispersed for about 1 to 3 minutes by an ultrasonic dispersion device; Measure the volume and the number of the toner particles or the toner by the equipment mentioned above with an aperture of 100 μm; and calculate the volume distribution and the number distribution. The weight average particle diameter (D4) and the number average particle diameter (D1) of the toner can be obtained according to the obtained distributions, The whole range is a particle diameter of from 2.00 to not greater than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm. The toner having such a significantly round form is preferably manufactured by cross-linking and/or elongating reaction of toner compositions containing a polyester prepolymer having a functional group having a nitrogen atom, a polyester, a coloring agent, and a releasing agent in an aqueous medium under the presence of resin particulates. The toner prepared in this reaction can reduce the occurrence of hot offset by hardening the surface of the toner, which results in reduction of contamination of the fixing device and its reflection on images. An example of the prepolymer formed of a modified polyester based resin for use in manufacturing toner is a polyester prepolymer (A) having an isocyanate group and an example of the compound that elongates or cross-links with the prepolymer is an amine (B). The polyester prepolymer (A) mentioned above can be prepared by, for example, reacting a polyester having an active hydrogen group, which is a polycondensation product of a polyol (1) and a polycarboxylic acid (2), with a polyisocyanate (3).

Specific examples of the active hydrogen group contained in the polyester mentioned above including the mentioned above include, but are not limited to, hydroxyl groups (alcohol hydroxyl groups and phenol hydroxyl groups), amino groups, carboxylic groups, and mercarpto groups. Among these, alcohol hydroxyl groups are preferable. Examples of the polyol (1) are diol (1-1) and polyol (triol or higher polyol) (1-2) and using diol (1-1) or a mixture of diol (1-1) with a small amount of (1-2) is preferred. Specific examples of the diols (1-1) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc. Among these compounds, alkylene glycols having 2 to 12 carbon atoms and adducts of a bisphenol with an alkylene oxide are preferable. Adducts of a bisphenol with an alkylene oxide, and a combinational use of an adduct of a bisphenol with an alkylene oxide and an alkylene glycol having 2 to 12 carbon atoms are more preferable. Specific examples of the polyols (1-2) include, but are not limited to, fatty acid alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc. Specific examples of suitable polycarboxylic acids (2) include, but are not limited to, dicarboxylic acids (2-1) and polycarboxylic acids (2-2) having three or more carboxyl groups Among these, using the dicarboxylic acid (2-1) alone or a mixture of the dicarboxylic acid (2-1) with a small amount of polycarboxylic acid (2-2) is preferred.

Specific examples of the dicarboxylic acids (2-1) include, but are not limited to, alkylene dicarboxylic acids (e.g., succinic acid, adipic acid and sebacic acid): alkenylene dicarboxylic acids (e.g., maleic acid and fumaric acid); aromatic dicarboxylic acids (e.g., phthalic acid, isophthalic acid, terephthalic acid, naphthalene dicarboxylic acids; etc.). Among these compounds, alkenylene dicarboxylic acids having from 4 to 20 carbon atoms and aromatic dicarboxylic acids having from 8 to 20 carbon atoms are preferable. Specific examples of the polycarboxylic acids (2-2) having three or more hydroxyl groups include, but are not limited to, aromatic polycarboxylic acids having from 9 to 20 carbon atoms (e.g., trimellitic acid and pyromellitic acid). In addition, compounds prepared by reaction between anhydrides or lower alkyl esters (e.g., methyl esters, ethyl esters or isopropyl esters) of the polycarboxylic acids mentioned above and polyols (1) can be used as the polycarboxylic acid (2). A suitable mixing ratio (i.e., an equivalence ratio [OH]/[COOH]) of a polyol (1) to a polycarboxylic acid (2) is from 2/1 to 1/1, preferably from 1.5/1 to 1/1, and more preferably from 1.3/1 to 1.02/1. Specific examples of the polyisocyanates (3) include, but are not limited to, fatty acid polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic fatty acid diisocyanates (e.g., α,α,α',α'-tetramethyl xylylene diisocyanate); isocyanurates; blocked polyisocyanates in which the polyisocyanates mentioned above are blocked with phenol derivatives thereof, oximes or caprolactams; etc. These compounds can be used alone or in combination. A suitable mixing ratio of the polyisocyanate (3) is represented by the equivalent ratio (i.e., [NCO]/[OH]) of isocyanate group [NCO] to hydroxyl group [OH] in a polyester having a hydroxyl group, which is. from 5/1 to 1/1, preferably from 4/1 to 1.2/1 and more preferably from 2.5/1 to 1.5/1. When the molar ratio of [NCO] is too small, the urea content of urea-modified polyesters in the modified polyesters tends to be small, which leads to deterioration of the hot offset resistance. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. A ratio of the polyester (i) that is too small, for example, less than 0.5%, tends to degrade the hot offset resistance and prevent to have a good combination of the high temperature preservability and the low temperature fixing property. When the ratio is too large, for example, greater than 40% by weigh, the low temperature fixability of the toner tends to deteriorate. The number of isocyanate groups included in the prepolymer (A) per molecule is normally not less than 1, preferably from 1.5 to 3, and more preferably from 1.8 to 2.5. When the number of isocyanate groups is too small, the molecular weight of urea-modified polyester tends to be small and thus the hot offset resistance easily deteriorates. Specific examples of the amines (B) include, but are not limited to, diamines (B1), polyamines (B2) having three or more amino groups, amino alcohols (B3), amino mercaptans (B4), amino acids (B5), and blocked amines (B6) in which the amines (B1) to (B5) mentioned above are blocked. Specific examples of the diamines (B1) include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminocyclohexane and isophoron diamine); fatty acid diamines (e.g., ethylene diamine, tetramethylene diamine, and hexamethylene diamine); etc. Specific examples of the polyamines (B2) having three or more amino groups include, but are not limited to, diethylene triamine, and triethylene tetramine. Specific examples of the amino alcohols (B3) include, but are not limited to, ethanol amine and hydroxyethyl aniline. Specific examples of the amino mercaptan (B4) include, but are not limited to, aminoethyl mercaptan and aminopropyl mercaptan.

Specific examples of the amino acids (B5) include, but are not limited to, amino propionic acid and amino caproic acid. Specific examples of the blocked amines (B6) include, but are not limited to, ketimine compounds which are prepared by reacting one of the amines (B1) to (B5) mentioned above with a ketone such as acetone, methyl ethyl ketone and methyl isobutyl ketone; oxazoline compounds, etc. Among these, (B1) and a mixture of (B1) with a small amount of (B2) are preferred. Furthermore, the molecular weight of the urea-modified polyesters can be adjusted by using a molecular weight control agent. Specific examples of the molecular weight control agent include, but are not limited to, monoamines (e.g., diethyl amine, dibutyl amine, butyl amine and lauryl amine) having no active hydrogen group, and blocked amines (i.e., ketimine compounds) prepared by blocking the monoamines mentioned above. The mixing ratio of the isocyanate group to the amines (B), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2. When the mixing ratio is too large or too small, the molecular weight of the resultant urea-modified polyester (i) decreases, resulting in deterioration of the hot offset resistance of the resultant toner. In the present invention, the urea-modified polyester (i) may contain a urethane bonding in addition to the urea bonding. The molar ratio of the content of the urea bonding to the content of the urethane bonding is from 100/0 to 10/90, preferably from 80/20 to 20/80 and more preferably from 60/40 to 30/70. When the molar ratio of the urea bonding is too small, the anti-hot offset property tends to deteriorate. By the reaction specified above, modified polyesters for use in the toner, particularly, the urea-modified polyester (i) is manufactured. This urea-modified polyester (i) is manufactured by the one-shot method or a prepolymer method. The weight average molecular weight of the urea-modified polyester (i) is 10,000 or higher, preferably from 20,000 to 10,000,000 and more preferably from 30,000 to 1,000,000. When the weight average molecular weight is too small, the anti-hot offset property tends to deteriorate. The number average molecular weight of the urea-modified polyester is not particularly limited when an unmodified polyester (ii), which is described later, is used, The number average molecular weight is controlled to obtain the weight average molecular weight within the range specified above. When the polyester (i) is singly used, the number average molecular weight is 20,000 or lower, preferably from 1,000 to 10,000 and more preferably from 2,000 to 8,000. When the number average molecular weight is too large, the low temperature fixability of the resultant toner tends to deteriorate, and in addition the gloss of full color images degrades when the toner is used in a full color image forming apparatus. With regard to the toner related to the present invention, a combination of the urea-modified polyester (i) with an unmodified polyester (ii) as the component of a binder resin can be used as well as the single usage of the urea-modified polyester (i). This combinational use of modified polyester (i) and polyester (ii) is more preferable to the single use of (i) in terms of improvement on the low temperature fixability of a toner and the gloss property when the toner is used in a full-color image forming apparatus. Examples of the polyester (ii) are polycondensation products formed of the polyol (1) and the polycarboxylic acid (2) which have the same polyester component specified for the modified polyester (i) and preferred examples are the same as those for the modified polyester (i). In addition, a polyester modified by a bonding (e.g., urethane bonding) other than urea bonding can be used as the polyester (ii). The polyester (i) and the polyester (ii) that are at least partially compatible in each other are preferable in terms of the low temperature fixing property and the anti-hot offset property. Therefore, the polyester (ii) preferably has a component similar to the polyester component of the polyester (i). The weight ratio of the polyester (i) to the polyester (ii) is from 5/95 to 80/20, preferably from 5/95 to 30/70, more preferably from 5/95 to 25/75 and particularly preferably from 7/93 to 20/80 when the polyester (ii) is contained. A ratio of the polyester (i) that is too small, for example, less than 5%, tends to degrade the hot offset resistance and be disadvantageous to have a good combination of the high temperature preservability and the low temperature fixing property. The peak molecular weight of the polyester (ii) is from 1,000 to 30,000 and preferably from 1,500 to 10,000 and more preferably from 2,000 to 8,000. When the peak molecular weight is too small, the high temperature preservability tends to deteriorate. When the peak molecular weight is too large, the low temperature fixing property tends to deteriorate. The hydroxyl value of the polyester (ii) is preferably 5 or higher, more preferably from 10 to 120, and further preferably from 20 to 80. A hydroxyl value that is too small may be disadvantageous in terms of having a good combination of the high temperature preservabiltiy and the low temperature fixing property. The acid value of the polyester (ii) is from 1 to 30 and preferably from 5 to 20. The polyester (ii) having an acid value tends to cause the resultant toner to have a negative charging property. The glass transition temperature (Tg) of the binder resin in the toner related to the present invention is preferably from 50 to 70° C. and more preferably from 55 to 65° C. A toner that has an excessively low glass transition temperature easily causes blocking when the toner is preserved at a high temperature. When the glass transition temperature is too high, the low temperature fixing property tends to deteriorate. The dry toner for use in the present invention tends to have a relatively good high temperature preservability due to the presence of the urea-modified polyester resins even when the dry toner has a low glass transition temperature when compared with a known polyester based toner. With respect to the storage elastic modulus of the toner binder resin, the temperature (TG') at which the storage elastic modulus is 10,000 dyne/cm$^2$ when measured at a frequency of 20 Hz is not lower than 100° C., and preferably from 110 to 200° C. When t the temperature (TG') is too low, the anti-hot offset property tends to deteriorate. With respect to the viscosity of the toner binder resin, the temperature (Tη) at which the viscosity is 1,000 poise when measured at a frequency of 20 Hz is not higher than 180° C., and preferably from 90 to 160° C. When the temperature (Tη) is too high, the low temperature fixability of the toner tends to deteriorate. In order to achieve a good combination of the low temperature fixability and the hot offset resistance, the TG' is preferably higher than the Tη. Specifically, the difference (TG'−Tη) is preferably not less than 0, more preferably not less than 10° C., and furthermore preferably not less than 20° C. The difference particularly has no specific upper limit. In order to achieve a good combination of the high temperature preservability and the low temperature fixability, the difference (Tη−Tg) is preferably from 0 to 100° C., more preferably from 10 to 90° C. and furthermore preferably from 20 to 80° C.

The binder resin (toner binder) is manufactured by the following method, etc. Heat the polyol (1) and the polycarboxylic acid (2) to 150 to 280° C. under the presence of known esterification catalysts such as tetrabuthoxy titanate, dibutyl tin oxide, etc.; remove produced water with a reduced pressure, if necessary, to obtain a polyester having a hydroxyl group; react the polyester with the polyisocyanate (3) at 40 to 140° C. to obtain the prepolymer (A) having an isocyanate group; and furthermore, conduct reaction between the prepolymer (A) and the amine (B) at 0 to 140° to obtain a urea-modified polyester. During the reaction of the polyisocyanate (3) and the prepolymer (A) and the amine (B), a solvent is optionally used. Examples of such solvents are inert compounds to the isocyanate (3) and specific examples thereof include, but are not limited to, inert compounds to the isocyanate (3) such as aromatic solvents (toluene, xylene); ketones (acetone, methylethyl ketone, methylisobutyl ketone); esters (ethyl acetate); amides (dimethylformamide, dimethylacetamide); and ethers (tetrahydrofuran). When the polyester (ii) which is not modified by urea bonding is used in combination, the polyester (ii) is prepared by the same method as for the polyester having a hydroxyl group and dissolved in and mixed with the solution of the polyester (i) after the reaction. The toner for use in the present invention can be manufactured by the following method but this is not limiting. Suitable aqueous media is not limited to simple water. Mixtures of water with a solvent which can be mixed with water are also suitably used. Specific examples of such solvents include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc. The toner particles can be prepared by reacting a dispersion body formed of the prepolymer (A) having an isocyanate group with the amine (B) in an aqueous medium or using a preliminarily manufactured urea modified polyester (i). The dispersion body formed of the urea-modified polyester (i) or the prepolymer (A) in an aqueous medium can be stably formed by, for example, a method in which a composition of toner material containing the urea-modified polyester (i) and the prepolymer (A) is added to the aqueous medium and dispersed by shearing force. The prepolymer (A) and other toner compositions (also referred to as toner material) such as a coloring agent, a coloring agent master batch, a releasing agent, a charge control agent, and an unmodified polyester resin can be mixed in an aqueous medium when forming a dispersion body. However, a method in which toner material is preliminarily mixed and then the mixture is added to and dispersed in an aqueous medium is preferable In addition, in the present invention, a coloring agent, a releasing agent, and a charge control agent, etc. are not necessarily mixed when particles are formed in an aqueous medium but can be added after particles are formed in an aqueous medium. For example, after particulates containing no coloring agent are formed, a coloring agent is added thereto by a known dying method. There is no specific limit to the dispersion method. Specific examples thereof include, but are not limited to, a low speed shearing method, a high speed shearing method, a friction method, a high pressure jet method, an ultrasonic wave method. Among these methods, the high speed shearing method is preferable because a dispersion body having a particle diameter of from 2 to 20 μm can be easily prepared.

When a high speed shearing type dispersion machine is used, there is no specific limit to the rotation speed, but the rotation speed is normally from 1,000 to 30,000 rpm, and preferably from 5,000 to 20,000 rpm. There is no specific limit to the dispersion time but the dispersion time is typically from 0.1 to 5 minutes in the batch system. The temperature during the dispersion process is from 0 to 150° C. (under pressure), and preferably from 40 to 98° C. A high temperature is preferable during the dispersion process because the viscosity of the dispersion body containing the urea-modified polyester (i) and the prepolymer (A) is low in a high temperature, which is advantageous to perform easy dispersion.

The content of the aqueous medium is typically from 50 to 2,000 parts by weight, and preferably from 100, to 1,000 parts by weight based on 100 parts by weight of the toner component including the urea-modified polyester (i) and the prepolymer (A). When the ratio of the aqueous medium is too small, the dispersion of the toner component in the aqueous medium is not satisfactory, and thereby the resultant toner particles do not have a desired particle diameter. In contrast, a ratio of the aqueous medium that is too large is not preferred in terms of the economy. A dispersion agent can be optionally used. The particle size distribution is sharp and dispersion is stabilized when a dispersion agent is used. In the process in which the urea-modified polyester (i) is synthesized from the prepolymer (A), the amine (B) can be added to an aqueous medium before the toner component is dispersed therein, or to a liquid dispersion in which the toner component is dispersed in an aqueous medium to start reaction at the particle interface. In the latter case, the urea-modified polyester is preferentially formed at the surface portions of the toner particles. Thus, a gradient of the concentration of the urea-modified polyester can be made in the thickness direction of the toner particle. Specific examples of dispersion agents to emulsify and disperse an oil phase in which the toner component is dispersed in liquid containing water include, but are not limited to, anionic surface active agents such as; alkylbenzene sulfonic acid salts, α-olefin sulfonic acid salts, and phosphoric acid esters; cationic surface active agents such as amine salt type surface active agents such as alkyl amine salts, amino alcohol fatty acid derivatives, polyamine fatty acid derivatives, and imidazoline, and quaternary ammonium salt type anionic surface active agents such as alkyl trimethyl ammonium salts, dialkyl dimethyl ammonium salts, alkyl dimethyl benzyl ammonium salts, pyridinium salts, alkyl isoquinolinium salts, and benzetonium chloride; and nonionic surface active agents such as amopholytic surface active agents such as alanine, dodecyldi(amino ethyl)glycine, di(octyl amonoethyl)glycine, and N-alkyl-N,N-dimethyl ammonium betaine. In addition, just an extremely small amount of a surface active agent having a fluoroalkyl group is effective.

Specific examples of the anionic surface active agents having a fluoroalkyl group, which are preferably used, include, but are not limited to, fluoroalkyl carboxylic acids having 2 to 10 carbon atoms and their metal salts, disodium pexfluorooctane sulfonylglutamate, sodium 3-{omega-fluoroalkyl(having 6 to 11 carbon atoms)oxy}-1-alkyl(having 3 to 4 carbon atoms)sulfonate, sodium 3-{omega-fluoroalkanoyl(having 6 to 8 carbon atoms)-N-ethylamino}-1-propanesulfonate, fluoroalkyl (having 11 to 20 carbon atoms)carboxylic acids and their metal salts, perfluoroalkylcarboxylic acids and their metal salts, perfluoroalkyl(having 4 to 12 carbon atoms)sulfonate and their metal salts, perfluorooctanesulfonic acid diethanol amides, N-propyl-N-(2-hydroxyethyl)perfluorooctanesulfone amide, perfluoroalkyl(having 6 to 10 carbon atoms)sulfoneamidepropyltrimethylammonium salts, salts of perfluoroalkyl (having 6 to 10 carbon atoms)-N-ethylsulfonyl glycin, and monoperfluoroalkyl(having 6 to 16 carbon atoms)ethylphosphates.

Specific examples of the marketed products of such surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents includem but are not limited to, primary, secondary and tertiary fatty acid amines having a fluoroalkyl group, fatty acid quaternary ammonium salts such as perfluoroalkyl (having 6 to 10 carbon atoms) sulfoneamide propyltrimethyl ammonium salts, benzalkonium salts, benzetonium chloride, pyridinium salts and imidazolinium salts. Specific examples of the marketed products of the cationic surface active agents include, but are not limited to, SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited).

An inorganic compound such as tricalcium phosphate, calcium phosphate, titanium oxide, colloidal silica, and hydroxyapatite can also be used as the inorganic compound dispersant hardly soluble in water. In addition, the dispersion droplets can be stabilized by a polymeric protective colloid. For example, the following can be used: acids such as acrylic acid, methacrylic acid, α-cyanoacrylic acid, α-cyanomethacrylic acid, itaconic acid, crotonic acid, fumaric acid, maleic acid and maleic anhydride; (meth)acrylic monomer having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide; vinyl alcohols mentioned above or its ethers such as vinyl methyl ether, vinyl ethyl ether and vinyl propyl ether; esters of vinyl alcohol and a compound having a carboxylic group such as vinyl acetate, vinyl propionate and vinyl butyrate, amide compounds such as methylol compounds include, but are not limited to, acrylamide, methacrylamide and diacetone acrylamide and their methylol compounds; acid chlorides such as acrylic acid chloride and methacrylic acid chloride; homopolymers or copolymers having a nitrogen atom or a heterocyclic ring thereof such as vinyl pyridine, vinyl pyrrolidone, vinyl imidazole and ethylene imine; polyoxyethylenes such as polyokyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters, and celluloses such as methyl cellulose, hydroxyethyl cellulose and hydroxypropyl cellulose.

When a compound such as calcium phosphate which are soluble in an alkali or an acid is used as a dispersion stabilizer, the dispersion stabilizer is removed from particulates by dissolving the dispersion stabilizer with an acid such as hydrochloric acid followed by washing with water. The dispersion stabilizer can also be removed by another method such as zymolytic method (decomposition by enzyme) Such a dispersion agent (stabilizer) may remain on the surface of toner particles. However, removing and washing the dispersion agent is preferable in terms of the charging property of toner particles. In addition, a solvent in which the urea-modified polyester (i) or the prepolymer (A) is soluble can be used to decrease the viscosity of the toner component. Usage of such a solvent is preferable in terms of causing the particle size distribution to be sharp. Also, a volatile solvent is preferable because the solvent can be easily removed from liquid dispersion after the particles are formed. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These can be used alone or in combination. Among these solvents, aromatic solvents such as toluene and xylene; and halogenated hydrocarbons such as methylene chloride, 1,2-dichloroethane, chloroform, and carbon tetrachloride are preferably used. The aromatic solvents such as Toluene and xylene are more preferable. The addition amount of such a solvent is from 0 to 300 parts by weight, preferably from 0 to 100 parts by weight, and more preferably from 25 to 70 parts by weight, based on 100 parts by weight of the prepolymer (A). When such a solvent is used, the solvent is removed therefrom upon application of heat thereto under a normal or reduced pressure after the elongation reaction and/or a crosslinking reaction of the particles. The crosslinking time and/or the elongation time is determined depending on the reactivity determined according to the combination of the isocyanate group structure of the prepolymer (A) and the amine (B) and is typically from 10 minutes to 40 hours, and preferably from 2 to 24 hours. The reaction temperature during the dispersion process is from 0 to 150° C., and preferably from 40 to 98° C. A known catalyst can be optionally used. Specific examples thereof include, but are not limited to, dibutyltin laurate and dioctyltin laurate. In order to remove the organic solvent from the thus prepared emulsion (dispersion), a drying method, in which the temperature of the emulsion is gradually raised to completely evaporate and remove the organic solvent from the drops dispersed in the emulsion, can be used. Alternatively, a drying method in which the emulsion is sprayed in a dry atmosphere to completely evaporate and remove not only the non-water-soluble organic solvent but also the remaining aqueous medium in the drops in the emulsion to form toner particulates can be used. The dry atmosphere can be prepared by heating gases such as air, nitrogen, carbon dioxide and combustion gases. Particularly, various kinds of air streams which have been heated to a temperature higher than the highest boiling point of the solvents used in the emulsion are typically used. The drying treatment in a short period of time with a drying device such as a spray dryer, a belt dryer, a rotary kiln, etc. is sufficient to obtain desired quality. When the thus prepared toner particles have and maintain a wide particle size distribution after the washing and drying treatment of the particles, the particle size distribution can be adjusted by a classification treatment to obtain a desired particle size distribution.

The classification treatment can be performed in a liquid dispersion using a cyclone, a decanter, or a centrifugal to remove fine particles therefrom. Classification treatment can be performed for powder of the toner particles obtained after drying but classification in the liquid including the particles is preferable in terms of the efficiency. Obtained unnecessary toner particulates or coarse particles can be returned to the mixing and kneading process for reuse even when the toner particulates or coarse particles are in a wet condition. Removing the dispersion agent from the liquid dispersion as much as possible is preferable and is preferably conducted together with the classification process described above. The toner powder obtained after drying can be mixed with other fine particles such as release agent particles, charge control agent particles, fluidizing agent particles and coloring agent particles. Such mixed fine particles can be fixed and fused on the surface of the toner particles by applying a mechanical impact thereto. Thus, the fine particles can be prevented from being detached from the surface of the thus obtained complex particles. Specific examples of such mechanical impact application methods include, but are not limited to, methods in which an impact is applied to the mixture by a blade rotating at a high speed and methods in which the mixture is put into a jet air to collide the particles against each other or the complex particles into a suitable collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Known pigments and dyes used as coloring agents for toner can be used and specific examples thereof include, but are not limited to, carbon black, lamp black, black iron oxide, indigo, Nigrosine dyes, aniline blue, phthalocyanine blue, phthalocyanine green, Hansa Yellow GR, rhodamine 6C lake, Calco oil blue, chrome yellow, Quinacridone Red, Benzidine yellow, and rose Bengal. These can be used alone or in combination. The toner can have magnetic characteristics optionally in the toner by containing magnetic components of iron oxides such as ferrite, magnetite, maghematite, metals such as iron, cobalt, and nickel, alloyed metals thereof with other metals or mixtures thereof. These magnetic components can be also used as coloring agent components or in combination with other coloring agents. The number average particle diameter of the coloring agent in the toner for use in the present invention is preferably from 0.5 μm or smaller, more preferably from 0.4 μm or smaller, and from 0.3 μm or smaller. When the number average particle diameter is excessively large, the dispersion property of the pigment tends to be insufficient so that desirable transparency might not be obtained.

Coloring agent particles having a number average particle diameter smaller than 0.1 μm is sufficiently small in comparison with a half wavelength of optical light and is thus considered to have no adverse impact on the reflectivity or absorption characteristics of light. Therefore, coloring agent particles having a number average particle diameter smaller than 0.1 μm contributes to improve color reproducibility and transparency for a transparent sheet having a fixed image thereon. On the other hand, when coloring agent particles having an excessively large number average particle diameter, for example, greater than 0.5 μm, are contained in a large amount, the incident light tends to hardly transmit or be easily scattered so that the lightness and the colorness of projected images of transparent sheets tend to deteriorate. Furthermore, the coloring agent is easily detached from the surface of the toner particle, which leads to problems such as fogging, contamination of the drum, bad cleaning performance. The content ratio of coloring agents having a number average particle diameter greater than 0.7 μm is preferably not greater than 10% by number and more preferably not greater than 5% by number.

In addition, when the coloring agent is preliminarily mixed and kneaded with part or all of binder resin and a preliminarily added moistening liquid, the binder resin and the coloring agent are sufficiently attached to each other at the initial stage. The coloring agent is effectively dispersed in the toner particles in the following toner manufacturing process and the dispersion particle diameter of the coloring agent decreases so that further suitable transparency is obtained. The binder resins specified above used as the binder resins for toner are used as the binder resins for use in preliminary kneading and mixing but the binder resins for use in preliminary kneading and mixing are not limited thereto.

A specific method of preliminarily mixing and kneading the mixture of the binder resin and a coloring agent together with a moistening liquid is to: mix a binder resin, a coloring agent, moistening liquid by a blender such as HENSCEL MIXER; and mix and knead the obtained mixture with a kneader such as a two-roll or a three-roll at a temperature lower than the melting point of the binder resin to obtain a sample.

In addition, typical known liquid can be used as the moistening liquid considering the solubility of the binder resin and the wettability of the coloring agent. Organic solvents such as acetone, toluene, and butanone, and water are preferred in terms of the dispersion property of the coloring agent. Among these, the usage of water is particularly preferred in consideration of environment, and maintenance of dispersion stability of the coloring agent in the toner manufacturing process thereafter. According to this method, the particle diameter of the coloring agent particles contained in the obtained toner decreases and in addition the uniformity of the dispersion status of the particles increases. Therefore, the color reproducibility of a projected image on a transparent sheet is further improved.

In the toner, a releasing agent (represented by wax) is preferably contained in addition to the binder resin and the coloring agent. Any known releasing agent can be suitably used. Specific examples of the release agent (wax) include, but are not limited to, polyolefin waxes such as polyethylene waxes and polypropylene waxes; long chain hydrocarbons such as paraffin waxes and SAZOL waxes; waxes including a carbonyl group, etc. Among these waxes, the waxes including a carbonyl group are particularly preferable.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these waxes, the waxes including a carbonyl group are particularly preferable. The releasing agent preferably has a melting point of from 40 to 160° C., more preferably from 50 to 120° C., and furthermore preferably from 60 to 90° C. When the melting point of the releasing agent is too low, the high temperature preservability of the toner tends to deteriorate. In contrast, when the melting point is too high, a cold offset problem, i.e., an offset phenomenon that occurs at a low fixing temperature, tends to occur. The releasing agent preferably has a melt viscosity of from 5 to 1000 cps and more preferably from 10 to 100 cps at a temperature 20° C. higher than the melting point of the releasing agent. When the melt viscosity is too high, the effect of improving the hot offset resistance and low temperature fixability tends to be reduced. The content of the releasing agent in the toner is from 0 to 40% by weight and preferably from 3 to 30%. Also, the toner can optionally contain a charge control agent to improve the charging and quicken the rise thereof. A charge control agent formed of colored material changes color of the toner. Therefore, the charge control agent is preferably made of transparent material or material having a white color or a color close thereto. Any known charge control agent can be used. Specific examples thereof include, but are not limited to, triphenylmethane dyes, chelata compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and metal salts of salicylic acid derivatives. Specific examples of the marketed products of the charge control agents include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, and a quaternary ammonium group. The content of the charge control agent is determined depending on the kind of the binder resin, whether or not an additive is optionally added and the toner manufacturing method (including the dispersion method), and thus is not unambiguously defined. However, the content of the charge control agent is preferably from 0.1 to 10 parts and more preferably from 0.2 to 5 parts by weight, based on 100 parts by weight of the binder resin. When the content is too large, the toner tends to have an excessively large amount of charge, which reduces the effect of the main charge control agent. Therefore, the electrostatic attraction force between the developing roller and the toner increases, resulting in deterioration of the fluidity of the toner and a decrease in the image density. The charge control agent can be dissolved or dispersed in an organic solvent after the charge. control agent is kneaded together with a master batch pigment and resin. In addition, the charge control agent can be directly dissolved or dispersed in an organic solvent when the toner component is dissolved or dispersed in an organic solvent. Alternatively, the charge control agent may be fixed on the surface of the toner particles after the toner particles are prepared. In addition, resin particulates can be optionally added to stabilize dispersion when the toner component is dispersed in an aqueous medium in the toner manufacturing process. Any resins that form an aqueous dispersion body. can be used as the resin particulates. Specific examples of these resins include, but are not limited to, thermoplastic resins or thermosetting (thermocuring) resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. Among these resins, vinyl resins, polyurethane resins, epoxy resins, polyester resins, and mixtures thereof are preferably used because an aqueous dispersion body including fine spherical particulates can be easily prepared. Specific examples of the vinyl resins include, but are not limited to, polymers prepared by polymerizing or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers. Inorganic particulates are suitable as an external additive to assist the fluidity, the developability and the charging property of toner particles. Such inorganic particulates preferably have a primary particle diameter of from 5 nm to 2 μm, and more preferably from 5 nm to 500 nm. In addition, the specific surface area of such inorganic particulates measured by a BET method is preferably from 20 to 500 $m^2/g$. The content of the inorganic particulates is preferably from 0.01 to 5% by weight, and more preferably from 0.01 to 2.0% by weight, based on the total weight of the toner.

Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. In addition, other polymer particulates such as polymers and copolymers of styrene, methacrylates, acrylates or the like prepared by a soap-free emulsion polymerization method, a suspension polymerization method or a dispersion polymerization method and polymer particles of polycondensation or thermocuring resins such as silicone resins, benzoguanamine resins and nylon resins can also be used as the external additive. These fluidizers can be hydrophobized by surface treatment to improve the hydrophobic property and thus prevent deterioration of the fluidity and charging properties of the toner under a high humidity condition. Specific preferred examples of the surface treatment agents (fluidizers) include, but are not limited to, silane coupling agents, silylation agents, silane coupling agents including a fluoroalkyl group, organic titanate coupling agents, aluminum coupling agents, silicone oils, and modified silicone oils. The toner for use in the present invention may include a cleaning improver to remove the toner (development agent) remaining on an image bearing member such as a photoreceptor and an intermediate transfer body.

Specific examples of the cleaning improvers include, but are not limited to, zinc stearate, calcium stearate and metal salts of fatty acid acids such as stearic acid; polymer particulates such as polymethyl methacrylate particulates and polystyrene particulates, which are prepared by a soap-free emulsion polymerization method or the like, etc. The polymer particulates preferably have a narrow particle size distribution and the weight average particle diameter thereof is preferably from 0.01 to 1 μm. Quality toner images can be formed with the stable developability as described above by using such toner. However, toner remaining on an image bearing member without being transferred to a transfer medium or an intermediate transfer medium by a transfer device is difficult to remove by a cleaning device because of the minuteness or rolling property of the toner and may pass through the cleaning device. Strongly pressing a toner removing member such as a cleaning blade against an image bearing member is required to completely remove the toner from the image member. Such pressure causes the working life of the image bearing member and the cleaning device to be short and consumes extra energy. When the pressure to the image bearing member is relaxed, toner and a carrier having a small particle diameter on the image bearing member is not completely removed. These damage the surface of the image bearing member when passing through the cleaning device, thereby fluctuating the performance of the image forming apparatus.

As described above, the image forming apparatus of the present invention has a large tolerable range for the variance of the surface status of the image bearing member, particularly the presence of a low resistant portion, and has a structure which highly reduces the variance in the charge control performance of the image bearing member. Therefore, extremely high quality images are stably formed by using a combination of the image forming apparatus and the toner having the composition described above over a long period of time.

In addition, the image forming apparatus of the present invention can be used for not only the polymerization toner having a suitable structure to obtain quality images but also pulverization toner having irregular forms. Also, the working life of the image forming apparatus is significantly elongated even when such pulverization toner having irregular forms is used. There is no specific limit to selection of material forming such pulverization toner as long as it can be used in electrophotography. Specific examples of the binder resins for use in the toner include, but are not limited to, styrene polymers and substituted styrene homopolymers such as poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; homopolymers of acrylic esters or copolymers thereof such as polymethyl acrylate, polybutyl acrylate, polymethyl methacrylate, and polybutyl methacrylate; polyvinyl derivatives such as polyvinyl chloride and polyvinyl acetate; polyester-based polymers, polyurethane based polymers, polyamide based polymers, polyimide based polymers, polyol based polymers, epoxy based polymers, terpene based polymers, fatty acid or alicyclic hydro carbon resins and aromatic oil resins. These can be used alone or in combination. Among these, styrene-acrylic based copolymers, polyester based tesins, polyol based resins, and mixtures thereof are more preferable in terms of electric characteristics and cost. Polyester based resins and polyol based resins are furthermore preferably used in terms of the fixing characteristics.

The pulverization toner is manufactured by: preliminarily mixing these resin components with the coloring agent component, the wax component, the charge control components, if desired; mixing and kneading them at a temperature around the melting point of the resin component; and cooling down the mixture followed by pulverization and classification process. The external additive specified above can be optionally admixed with the toner.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The photoreceptor drum 1 for use in Examples is manufactured as follows: Liquid applications of an undercoating layer, a charge generation layer, a charge transport layer and a protection layer, are sequentially applied to an aluminum drum (electroconductive substrate) having a diameter of 30 mm, and then dried to manufacture a photoreceptor (image bearing member) having an undercoating layer having a thickness of 3.6 μm, a charge generation layer having a thickness of about 0.14 μm, a charge transport layer having a thickness of 23 μm, and a surface layer having a thickness of about 3.5 μm. The surface layer is applied by a spraying method and the other layers are applied by a dip coating method. The recipe of liquid applications for respective layers are as follows:

Liquid Application for Undercoating Layer

| | |
|---|---|
| Alkyd resin (Beckozole 1307-60-EL, manufactured by Dainippon Ink and Chemicals, Inc.) | 6 parts |
| Melamine resin (SuperBeckamine 821-60, manufactured by Dainippon Ink and Chemicals, Inc.) | 4 parts |
| Titanium Oxide | 40 parts |
| Methylethylketone | 20 parts |
| Liquid Application for Charge Generation Layer | 2 parts |
| Y type oxotitanyl phthalocyanine pigment | |
| Polyvinyl butyral (S-LEC BM-S, manufactured by Sekisui Chemical Co., Ltd.) | 0.2 parts |
| Tetrahydrofuran | 50 parts |
| Liquid Application for Charge Transport Layer | 10 parts |
| Bisphenol A type polycarbonate resin (PANLITE K1300, manufactured by Teijin Chemicals Ltd.) | |
| Charge transport material represented by the following chemical structure (1) | 10 parts |

Chemical structure (1)

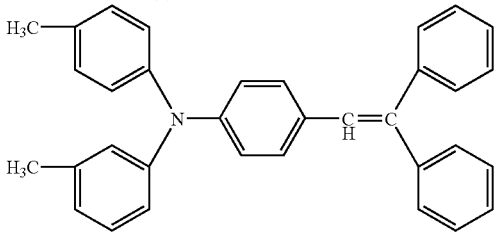

| | |
|---|---|
| Methylene chloride | 100 parts |
| Liquid Application for Surface Layer | 10 parts |
| Polycarbonate | |
| Charge transport material represented by the chemical structure (1) illustrated above | 7 parts |
| Alumina particulate (particle center diameter: 0.3 μm): | 6 parts |
| Dispersion helping agent (BYK-P104, manufactured by BYK Chemie Japan) | 0.08 parts |
| Tetrahydrofuran | 700 parts |
| Cyclohexanone | 200 parts |

Protection Agent Bar 1 to 6 (Containing Boron Nitride)

Boron nitride (BN) (NX5, manufactured by Momentive Performance Material Japan) is mixed and stirred with zinc stearate (GF200, manufactured by NOF Corporation) such that the content of boron nitride is an amount of 3% by weight, 5% by weight, 10% by weight, 30% by weight, 35% by weight, or 50% by weight. Powder obtained after stirring is placed into an aluminum die having an inside dimension of 8 mm×350 mm and pressed by a hydraulic pressing machine to 95% of the true specific gravity to manufacture the molded bodies 1 to 6 having a thickness of 7 mm. The both ends in the longitudinal direction of the molded body 1 to 6 are severed and the bottom face is cut to obtain protection agent bars 1 to 6 having a dimension of 7 mm×8 mm×310 mm. Double-faced adhesive tape is attached to the bottom of the respective protection agent bars 1 to 6 to fix them to a metal support.

Protection Agent Bar 7 (Simple Zinc Stearate)

The protection agent bar 7 is manufactured as follows:

Powder of zinc stearate (GF200, manufactured by NOF Corporation) is placed into an aluminum die having an inside dimension of 8 mm×350 mm and pressed by a hydraulic pressing machine to 95% of the true specific gravity to manufacture the molded body 7 having a thickness of 7 mm. The both ends in the longitudinal direction of the molded body 7 are severed and the bottom face is cut to obtain protection agent bars 7 having a dimension of 7 mm ×8 mm×310 mm. Double-faced adhesive tape is attached to the bottom of the protection agent bar 7 to fix it to a metal support.

Protection Agent Bar 8 (Containing Boron Nitride and Aluminum)

Each powder of 86 parts by weight of zinc stearate (GF200, manufactured by NOF Corporation), 10 parts by weight of boron nitride (BN) (NX5, manufactured by Momentive Performance Material Japan), and 4 parts by weight of aluminum particles having a spherical form having a particle diameter of 0.3 μm is mixed and stirred. Powder obtained after stirring is placed into an aluminum die having an inside dimension of 8 mm×350 mm and pressed by a hydraulic pressing machine to 95% of the true specific gravity to manufacture the molded body 8 having a thickness of 7 mm. The both ends in the longitudinal direction of the molded body 8 are severed and the bottom face is cut to obtain protection agent bar 8 having a dimension of 7 mm×8 mm×310 mm. Double-faced adhesive tape is attached to the bottom of the protection agent bar 8 to fix it to a metal support.

Evaluation on Image Forming Apparatus Having One of Protection Agent Bar 1 to 8

ISO test chart (refer to http.www.iso.org/jtc1/sc28) is used as the output chart for evaluation. The ISO test chart is output in A4 landscape. After printing the ISO test chart on 1,000 sheets, the amount of boron nitride attached to the image bearing member is evaluated by using ICP emission spectrochemical analysis. An image forming apparatus as illustrated in FIG. 4 having four image formation portions (process cartridges) including the photoreceptor and the protection agent application device described above as illustrated in FIG. 3 is remodeled based on a tandem type full color image forming apparatus (imagio MPC4500, manufactured by Ricoh Co., Ltd.) such that the protection agent application blade is replaced with an obtuse blade (counter manner) for evaluation. The image forming apparatus is evaluated under the conditions that the linear speed of the photoreceptor is 125 mm/s and a voltage in which an AC voltage having an amplitude of 1,100 V with a frequency of 1,450 Hz is overlapped with a DC voltage of −600 V is applied between the photoreceptor and the charging roller.

Examples 1 to 4

ISO test chart is printed on 1,000 sheets using the image forming apparatus in which one of the protection agent bars 1 to 4 is provided to the protection agent application device in an office environment (temperature; 24° C.; humidity: 60%). 1,000th output image is observed and evaluated by naked eyes to find that the quality is maintained for all the printing results of any of the image forming apparatuses. Furthermore, 1,000 images are output in the same manner as described above except that the temperature is changed to 23° C. and the humidity is changed to 80%. The quality is maintained for all the 1,000th images output by the image forming apparatuses. The photosensitive layer is peeled off from the aluminum substrate with a size of 25 cm width in the longitudinal direction of the photoreceptor and 3 cm width in the circumference direction as a sample for ICP emission spectrochemical analysis.

As a result of ICP emission spectrochemical analysis on the samples, the amount of boron nitride on the surface of the photoreceptor is calculated as 0.005 μg/cm$^2$, 0.01 μg/cm$^2$, 0.16 μg/cm$^2$, and 0.23 μg/cm$^2$ for respective photoreceptors.

Comparative Example 1

Images of Comparative Example 1 are formed and evaluated in the same manner as in Example 1 except that the protection agent bar is replaced with the protection agent 7. 1,000th output image is observed and evaluated by naked eyes to confirm two black streaks in the image. With regard to the next 1,000 image output in the different environment, two black streaks are similarly observed in the 1,000th output image. Since boron nitride is not contained in the protection agent bar 7, the amount of boron nitride is not measured but inferred to be 0.00 μg/cm$^2$.

Comparative Example 2

Images of Comparative Example 2 are formed and evaluated in the same manner as in Example 1 except that the protection agent bar is replaced with the protection agent bar 5. 1,000th output image is observed and evaluated by naked eyes to confirm blurred portions in the image when the details are observed. With regard to the next 1,000 image output in the different environment, image blurring clearly observed by naked eyes occurs to the 1,000th output image. The amount of boron nitride on the surface of the photoreceptor after 2,000 images are formed is 0.34 μg/cm$^2$.

This is considered to be because the balance between the amount of boron nitride in the protection agent bar 5 and the protection agent supplying speed of the protection agent application device falls off, meaning that boron nitride is excessively supplied from the protection agent bar 5.

Comparative Example 3

Images of Comparative Example 3 are formed and evaluated in the same manner as in Example 1 except that the protection agent bar is replaced with the protection agent bar 6. 1,000th output image is observed and evaluated by naked eyes to confirm image blurring. With regard to the next 1,000 image output in the different environment, the image blurring worsens. The amount of boron nitride on the surface of the photoreceptor after 2,000 images are formed is 0.57 μg/cm$^2$. This is considered to be because the balance between the amount of boron nitride in the protection agent bar 6 and the protection agent supplying speed of the protection agent application device falls off, meaning that boron nitride is excessively supplied from the protection agent bar 6.

Example 5

Images of example 5 are formed and evaluated in the same manner as in Example 4 except that the obtuse blade (extension blade) for applying protection agent to the photoreceptor is in contact therewith in a trailing manner instead of a counter manner. The quality is maintained for all the 1,000th images output by the image forming apparatuses. The amount of boron nitride on the surface of the photoreceptor after 2,000 images are formed is 0.27 μg/cm$^2$.

Example 6

Images of Example 6 are formed and evaluated in the same manner as in Example 5 except that the protection agent bar is replaced with the protection agent bar 3. The quality is maintained for all the 1,000th images output by any of the image forming apparatuses. The amount of boron nitride on the surface of the photoreceptor after 2,000 images are formed is 0.18 μg/cm$^2$.

Example 7

Images in Example 7 are formed and evaluated in the same manner as in Example 4 except that the obtuse blade (extension blade) for applying protection agent to the photoreceptor is changed to a right angle blade (proper supply of imagio MPC4500) and the right angle blade is brought in contact with the photoreceptor in a trailing manner instead of a counter manner. The quality is maintained for all the 1,000th images output by the image forming apparatuses. The amount of boron nitride on the surface of the photoreceptor after 2,000 images are formed is 0.28 μg/cm$^2$.

Example 8

Images of Example 8 are formed and evaluated in the same manner as in Example 7 except that the protection agent bar is replaced with the protection agent bar 3.

The quality is maintained for all the 1,000th images output by the image forming apparatuses. The amount of boron nitride on the surface of the photoreceptor after 2,000 images are formed is 0.19 μg/cm$^2$.

Comparative Example 4

Images of Comparative Example 4 are formed and evaluated in the same manner as in Example 4 except that the protection agent application blade (extension blade) of the protection agent application device is removed.

1,000th output image is observed and evaluated by naked eyes to confirm image blurring. After the next 1,000 image output in the different environment (temperature: 28° C.; humidity: 80%), the image blurring worsens. The amount of boron nitride on the surface of the photoreceptor after 2,000 images are formed is 0.46 μg/cm$^2$.

Example 9

Images of Example 9 are formed and evaluated in the same manner as in Example 3 except that the protection agent bar is replaced with the protection agent bar 8. The quality is maintained for all the 1,000th images output by the image forming apparatuses. The amount of boron nitride on the surface of the photoreceptor after 2,000 images are formed is 0.11 μg/cm$^2$.

The amount of boron nitride contained in the protection agent bar 8 is almost the same as that in the protection agent bar 3 but the amount of boron nitride attached to the surface of the photoreceptor decreases due to the effect of the presence of aluminum.

The evaluation results of Examples and Comparative Examples are shown in Table 1 with the amount of zinc stearate attached to the surface of the photoreceptor. The amount of zinc stearate attached to the surface of the photoreceptor is measured for each photoreceptor after the ISO test chart is output on 500 sheets. The photosensitive layer on the photoreceptor is peeled off from the aluminum substrate with a size of 25 cm width in the longitudinal direction of the photoreceptor and 3 cm width in the circumference direction as a sample for ICP emission spectrochemical analysis.

TABLE 1

| | Attachment amount of boron nitride (μg/cm2) after 1,000 image output | Attachment amount of boron nitride (μg/cm2) after 2,000 image output | Image evaluation after 1,000 image output | Image evaluation after formation 2,000 image outputs (temp.: 28° C.; humidity: 80%) | Attachment amount of zinc stearate (μg/cm2) After 500 image output |
|---|---|---|---|---|---|
| Comparative Example 1 | — | — | B | B | 0.9 |
| Example 1 | 0.004 | 0.005 | G | G | 0.4 |
| Example 2 | 0.008 | 0.01 | G | G | 0.6 |
| Example 3 | 0.16 | 0.16 | G | G | 1.1 |
| Example 4 | 0.23 | 0.23 | G | G | 1.8 |
| Comparative Example 2 | 0.33 | 0.34 | F | B | 4.4 |
| Comparative Example 3 | 0.58 | 0.57 | B | B | 6.2 |
| Example 5 | 0.27 | 0.27 | G | G | 1.8 |
| Example 6 | 0.19 | 0.18 | G | G | 1.5 |
| Example 7 | 0.28 | 0.28 | G | G | 2.0 |
| Example 8 | 0.19 | 0.19 | G | G | 1.3 |
| Comparative Example 4 | 0.45 | 0.46 | B | B | 4.8 |
| Example 9 | 0.11 | 0.11 | G | G | 0.8 |

In Table 1, G is good (good image), F is fair (a small problem with image) and B is bad (problem with image).

In addition, after 100 images are formed in the same manner (temperature: 24° C., humidity: 60%) as in Examples 1 to 9 and Comparative Examples 1 to 4, the attached amount of boron nitride is measured and the image is evaluated. Thereafter, another 100 images are formed in the same manner except that the temperature changed to 28° C. and the humidity is changed to 80%. The results are shown in Table 2. B, F and G represent the same as in Table 1.

TABLE 2

| | Attachment amount of boron nitride (μg/cm$^2$) | Image evaluation after 100 image outputs (temperature: 24° C.; humidity: 60%) | Image evaluation after formation 200 image outputs (temperature: 28° C.; humidity: 80%) |
|---|---|---|---|
| Example 1 | 0.001 | G | G |
| Example 2 | 0.007 | G | G |
| Example 3 | 0.16 | G | G |
| Example 4 | 0.23 | G | G |
| Example 5 | 0.27 | G | G |
| Example 6 | 0.19 | G | G |
| Example 7 | 0.28 | G | G |
| Example 8 | 0.19 | G | G |
| Example 9 | 0.12 | G | G |
| Comparative Example 1 | — | B | B |
| Comparative Example 2 | 0.33 | F | B |
| Comparative Example 3 | 0.58 | B | B |
| Comparative Example 4 | 0.45 | B | B |

This document claims priority and contains subject matter related to Japanese Patent Application No. 2008-204627, filed on Aug. 7, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member, configured to bear a latent image, comprising a surface layer;

a charging device configured to charge a surface of the image bearing member;

a latent image forming device configured to form the latent image on the surface of the image bearing member;

a development device configured to develop the latent image formed on the surface of the image bearing member with a development agent to form a toner image thereon;

a transfer device configured to transfer the toner image to a transfer medium;

a cleaning device configured to remove residual toner remaining on the surface of the image bearing member after transferring the toner image to the transfer medium; and a protection agent supplying device, configured to supply a protection agent to the surface layer of the image bearing member, that forms a protection layer thereon, wherein the protection agent comprises a metal soap and boron nitride, and an amount of the boron nitride in the protection layer applied to the image bearing member after image formation is 0.3 μg/cm$^2$ or less, wherein the protection agent supplying device comprises an extension blade that uniformly forms the protection layer on the surface of the image bearing member, and wherein the extension blade is in contact with the surface of the image bearing member in a counter manner.

2. The image forming apparatus according to claim 1, wherein a weight ratio of the metal soap to the boron nitride in the protection agent is from 70:30 to 95:5.

3. The image forming apparatus according to claim 1, wherein the protection agent comprises a filler.

4. The image forming apparatus according to claim 3, wherein the filler is an aluminum particle.

5. The image forming apparatus according to claim 1, wherein the surface layer of the image bearing member comprises a filler.

6. The image forming apparatus according to claim 1, wherein an amount of the metal soap in the protection layer after 500 images are formed is from 0.4 to 2.0 $\mu g/cm^2$.

7. The image forming apparatus according to claim 1, wherein an amount of the boron nitride in the protection layer after 1,000 images are formed is 0.3 $\mu g/cm^2$ or less.

8. The image forming apparatus according to claim 1, wherein a cross-section surface form of a portion of the extension blade which is in contact with the surface of the image bearing member has an obtuse angle.

9. The image forming apparatus according to claim 1, wherein the charging device employs a contact charging system or vicinity charging system in which an AC voltage overlapped with a DC voltage is applied to the surface of the image bearing member.

10. A process cartridge comprising:

an image bearing member configured to bear a latent image;

a charging device configured to charge a surface of the image bearing member;

a development device configured to develop the latent image formed on the surface of the image bearing member with a development agent to form a toner image thereon;

a cleaning device configured to remove residual toner remaining on the surface of the image bearing member after transferring the toner image to the recording medium; and a protection agent supplying device, configured to supply a protection agent to the surface of the image bearing member, that forms a protection layer thereon, wherein the process cartridge is detachably attachable to the image forming apparatus of claim 1.

11. A protection agent comprising:

a metal soap; and boron nitride, wherein a weight ratio of the metal soap to the boron nitride in the protection agent is from 70:30 to 95:5, and the protection agent is supplied to a protection agent supplying device contained in an image forming apparatus comprising an image bearing member configured to bear a latent image, a charging device configured to charge a surface of the image bearing member, a latent image forming device configured to form the latent image on the surface of the image bearing member, a development device configured to develop the latent image formed on the surface of the image bearing member with a development agent to form a toner image thereon, a transfer device configured to transfer the toner image to a transfer medium, a cleaning device configured to remove residual toner remaining on the surface of the image bearing member after transferring the toner image to the transfer medium, and the protection agent supplying device, configured to supply the protection agent to the surface of the image bearing member, that forms a protection layer thereon, wherein the protection agent supplying device comprises an extension blade that uniformly forms the protection layer on the surface of the image bearing member, and wherein the extension blade is in contact with the surface of the image bearing member in a counter manner.

12. The protection agent according to claim 11, further comprising a filler.

13. The protection agent according to claim 12, wherein the filler is an aluminum particle.

14. The protection agent according to claim 11, wherein the protection agent is formed to have a bar form.

15. The protection agent according to claim 14, wherein powder of the protection agent is compressed and molded to have the bar form.

* * * * *